US008898933B2

(12) United States Patent
Sakurai

(10) Patent No.: US 8,898,933 B2
(45) Date of Patent: Dec. 2, 2014

(54) TOE CAP AND TOE CAP EMBEDDED SHOE

(75) Inventor: Yoshinori Sakurai, Shibuya-ku (JP)

(73) Assignee: Midori Anzen Co., Ltd., Shibuya-ku, Tokyo (JP)

( * ) Notice: Subject to any disclaimer, the term of this patent is extended or adjusted under 35 U.S.C. 154(b) by 0 days.

(21) Appl. No.: 13/883,474

(22) PCT Filed: Jul. 6, 2011

(86) PCT No.: PCT/JP2011/065479

§ 371 (c)(1),
(2), (4) Date: May 3, 2013

(87) PCT Pub. No.: WO2012/060134

PCT Pub. Date: May 10, 2012

(65) Prior Publication Data

US 2013/0255111 A1 Oct. 3, 2013

(30) Foreign Application Priority Data

Nov. 5, 2010 (JP) ..... 2010-248883

(51) Int. Cl.
*A43B 23/08* (2006.01)
*A43B 7/32* (2006.01)

(52) U.S. Cl.
CPC ..... *A43B 23/081* (2013.01); *A43B 23/087* (2013.01); *A43B 7/32* (2013.01); *A43B 23/082* (2013.01)
USPC ..... 36/77 R; 36/72 R; 36/114; D2/972

(58) Field of Classification Search
CPC ..... A43B 23/08–23/087
USPC ..... 36/77 R, 72 R, 114; D2/972, 904
See application file for complete search history.

(56) References Cited

U.S. PATENT DOCUMENTS 1,965,431 A * 7/1934 Prewitt et al. ..... 36/77 R
2,268,435 A * 12/1941 Zucker ..... 36/7.5

(Continued)

FOREIGN PATENT DOCUMENTS

DE 1 684 494 U 10/1954
DE 1 154 016 U 9/1963

(Continued)

OTHER PUBLICATIONS

International Search Report (PCT/ISA/210) issued on Aug. 2, 2011, by the Japanese Patent Office as the International Searching Authority for International Application No. PCT/JP2011/065479.

(Continued)

*Primary Examiner* — Jila M Mohandesi
(74) *Attorney, Agent, or Firm* — Buchanan Ingersoll & Rooney PC

(57) ABSTRACT

A structure of a toe cap and a shoe having the toe cap embedded which does not disturb foot movement such as walking while protecting a toe against lateral collision with an object such as a wheel of a dolly includes a cup-shaped shell body which is formed by connecting a front end wall, bilateral side walls and an upper face wall with a gentle curved face, and an extension side wall disposed at least to one side wall as rearwardly extending a rear end edge of the side wall. The shoe having the toe cap embedded can sufficiently protect the toe even when an impact is applied from the outer side (i.e., the little toe) direction of the toe of which protection is not sufficient with a normal toe cap embedded shoe.

7 Claims, 17 Drawing Sheets

(56) References Cited

U.S. PATENT DOCUMENTS

| | | | | |
|---|---|---|---|---|
| 2,443,725 | A * | 6/1948 | Cobb | 36/77 R |
| 2,457,664 | A | 12/1948 | Harrison | |
| 2,563,751 | A * | 8/1951 | Rossi et al. | 36/114 |
| 2,601,162 | A | 6/1952 | McLaughlin | |
| 6,836,980 | B2 * | 1/2005 | Woods | 36/110 |
| D654,260 | S * | 2/2012 | Frappier et al. | D2/972 |
| 2004/0009337 | A1 | 1/2004 | Tanaka et al. | |

FOREIGN PATENT DOCUMENTS

| | | | |
|---|---|---|---|
| EP | 1 029 463 | A1 | 8/2000 |
| JP | 9-8601 | Y1 | 6/1934 |
| JP | 62-486 | Y2 | 1/1987 |
| JP | 8-080202 | A | 3/1996 |
| JP | 2003-310307 | A | 11/2003 |
| JP | 2004-041406 | A | 2/2004 |
| JP | 3776158 | B2 | 5/2006 |
| JP | 2011-103997 | A | 6/2011 |

OTHER PUBLICATIONS

Japanese Industrial Standards JIS T 8101 (2006)—40 pages.
International Standard ISO20344, "Personal protective equipment—Test methods for footwear", issued on Aug. 1, 2004, 47 pages.
Extended European Search Report issued Aug. 30, 2013, by the European Patent Office in corresponding European Patent Application No. 11837787.8 (8 pages).

* cited by examiner (a)

(b)

(a)

(b)

(a)

(b)

(c)

(a)

(b)

(a)

(b)

1. A case of high-speed moving of dolly (Normal walking level: about 1.4 m/sec)

| | | Height of extension side wall (mm) |
|---|---|---|
| | | 20 |
| Dolly load weight (kg) | 50 | Not run-on |
| | 100 | Not run-on |
| | 150 | Not run-on |
| | 200 | Not run-on |
| | 250 | Not run-on |
| | 300 | Not run-on |

2. A case of middle-speed moving of dolly (Slow walking level: 1.0 m/sec)

| | | Height of extension side wall (mm) |
|---|---|---|
| | | 20mm |
| Dolly load weight (kg) | 50 | Not run-on |
| | 100 | Not run-on |
| | 150 | Not run-on |
| | 200 | Not run-on |
| | 250 | Not run-on |
| | 300 | Not run-on |

3. A case of low-speed moving of dolly (Extremely slow walking level: 0.6 m/sec)

| | | Height of extension side wall (mm) |
|---|---|---|
| | | 20mm |
| Dolly load weight (kg) | 50 | Not run-on |
| | 100 | Not run-on |
| | 150 | Not run-on |
| | 200 | Not run-on |
| | 250 | Not run-on |
| | 300 | Not run-on |

FIG.15

TOE CAP AND TOE CAP EMBEDDED SHOE

TECHNICAL FIELD

The present invention relates to a toe cap and a toe cap embedded shoe.

BACKGROUND ART

A safety shoe having a hard toe cap embedded at a toe section has been known. Use of safety shoes increased since around 1955 (i.e., around the year Showa 30) to prevent accidents to foot. In 1972 (i.e., Showa 47), it became compulsory by Article 558 of Ordinance on Industrial Safety and Hygiene to wear safety shoe, and the standard thereof was established at the same time (see Non-patent document 1). Further, in many countries of the world, similar standards were established (see Non-patent document and the like).

A toe cap is embedded at a toe section of a shoe to protect toe, which is the most important element of a safety shoe and a protective sneaker, and performance and strength of the toe cap are defined in detail in the above standards. However, there has been a problem that a digitus quintus (i.e., a little toe) cannot be protected due to a reason in association with bending of the shoe. Accordingly, accidents damaging little toes caused by a dolly and the like which runs over a little toe laterally were not negligible among foot accidents.

The material of a toe cap varies from steel to resin, while the shape is formed to have a cup-shaped (alternatively, described as arch-shaped or dome-shaped) shell body which mainly covers a toe region from the base of a thumb, a skirt formed at a bottom face by folding the outer circumferential end inwardly, and an opening formed at a rear side to provide a foot inlet portion, as illustrated in drawings of Patent documents 1, 2 and 3.

PRIOR ART DOCUMENTS

Patent Document

[Patent document 1] Japanese Patent No. 3776158

[Patent document 2] Japanese Patent Application Laid-open No. 2003-310307

[Patent document 3] Japanese Patent Application Laid-open No. 2004-41406

Non-Patent Document

[Non-patent document 1] Japanese Industrial Standards JIS T 8101

[Non-patent document 2] International Standard ISO20344 "Personal protective equipment-Test methods for footwear" issued on Aug. 1, 2004

SUMMARY OF THE INVENTION

Problems to be Solved by the Invention

The safety shoe is a shoe in which a toe cap is embedded mainly to protect a toe from falling heavy object etc. at a site such as construction site. Safety shoes are used not only at construction sites but also at other working sites such as delivery center of transportation company where a large amount of load is carried with dollies pushed by operators. Running over a toe by a wheel of a dolly often occurs at working sites where dollies are used. Dollies having a wheel of which diameter is 20 cm or larger and the withstanding load is 300 kg or heavier are often used. When the wheel of the dolly collides an operator so as to run over a foot of laterally, the dolly wheel could hit little toe side which is not covered by the toe cap especially as illustrated in FIG. 4, which could result in injury.

In the above situation, injury of a little toe can be prevented by forming the toe cap large enough to cover the little toe. However, the toe cap formed to cover all of a toe including a little toe without changing the shape of conventional toe cap disturbs walking motion, since a rear opening edge of the toe cap, which is a foot inlet, contacts an instep region during foot bending motion. Therefore, conventional toe cap and a toe cap embedded shoe prioritize motion function of a shoe over protection of a foot around a little toe, which is sacrificed out of necessity.

The present invention is conceived in view of the above problems, it is an object of the present invention to provide various structures for a toe cap and a shoe having the toe cap embedded, which do not disturb foot motion such as walking and toe bending motion while protecting a toe from a laterally-applied load or impact such as collision of a wheel of a moving dolly, in addition to have a function to protect a toe like conventional toe caps.

Means to Solve the Problems

To solve the above problems, the present invention comprises; a toe cap for shoe to protect a toe from loads and impacts of heavy articles; body of the toe cap is formed as a cup-shaped shell body having a front end wall, left side wall, right side wall and an upper face wall forming a continuous gently curved surface; a rear end edge of the side wall of a little toe side of the toe cap extends rearward against a central portion of a rear end edge of the upper face wall to cover a side of the little toe; the toe cap is formed not to cover an upper surface of an instep region so as not to disturb vending motion of a foot; an extended side wall which does not exceed the height of the upper face wall is provided so as to protect the little toe against impact by a wheel of a dolly which carries heavy loads and collides from a side of the little toe.

The cup-shaped shell body mainly protects a toe region forward from the base of a thumb like the conventional toe cap, and the extension side wall protects a little toe section which is not sufficiently protected by the conventional toe cap. In addition, the toe cap according to the present invention does not disturb walking and toe bending motion while protecting the little toe section.

To solve the above problems, the present invention comprises; a toe cap embedded shoe to protect a toe from loads and impacts of heavy articles; a body of the toe cap is formed as a cup-shaped shell body having a front end wall, left side wall, right side wall and an upper face wall forming a continuous gently curved surface; a rear end edge of the side wall of a little toe side of the toe cap extends rearward against a central portion of a rear end edge of the upper face wall to cover a side of the little toe; the toe cap is formed not to cover an upper surface of an instep region so as not to disturb vending motion of a foot; an extended side wall which does not exceed the height of the upper face wall is provided so as to protect the little toe against impact by a wheel of a dolly which carries heavy loads and collides from a side of the little toe.

The toe cap embedded shoe protects a shoe toe section like a conventional toe cap embedded shoe, while protection of an area in the vicinity of a little toe is enhanced by a function of the toe cap having the extension side wall, which was not sufficient in the conventional toe cap embedded shoe.

In addition, the toe cap according to the present invention does not disturb walking and toe bending motion in spite of protection in the vicinity of a little toe is enhanced.

Further, to solve the above problems, the present invention comprises; a toe cap which covers a toe in a state of being embedded in a shoe toe; the toe cap is having a cup-shaped shell body formed by a front end wall, left side wall, right side wall and an upper face wall forming a continuous gently curved surface; a extension side wall disposed at least at one side wall to extend rearward against a rear end edge of the upper face wall.

The toe cap according to the present invention protects a toe region forward from the base of a thumb like the above mentioned toe cap while a little toe is protected by an extension side wall, which was not protected sufficiently in the conventional toe cap.

In addition, the toe cap according to the present invention, since an instep region does not contact the toe cap firmly, walking and toe bending motions are not disturbed.

Further, in the present invention, the rear end edge of the upper face wall of the toe cap is arranged along a direction approximately perpendicular to a longitudinal direction Since the rear end edge of the upper face wall is formed along the direction approximately perpendicular to the longitudinal direction, it is possible to provide the rear end edge at a position as far back as possible. Accordingly, a large area of the toe region can be covered by the toe cap and the toe can be bent largely toward forward.

Further, in the present invention, a section of the rear end edge of the upper face wall of the toe cap which extends from the approximate center toward a thumb side is arranged along a direction approximately perpendicular to a longitudinal direction. An extension upper wall of the toe cap has a curved edge forming an inward arc which connects a rear end edge of the extension side wall and the vicinity of the center of the rear end edge of the upper face wall, or an intermediate position between the vicinity of the approximate center and the side wall at a little toe side.

By arranging the section of the rear end edge of the upper face wall extending from the approximate center toward the thumb side along the direction approximately perpendicular to the longitudinal direction, the rear end edge can be provided at a position as far back as possible within a extent that the rear end edge does not disturb the motion of the toe which bends largely toward forward.

Further, by arranging the extension upper wall to have a curved edge forming an inward arc which connects the rear end edge of the extension side wall in the vicinity of the approximate center of the rear end edge of the upper face wall, or the intermediate position between the vicinity of the approximate center with the side wall at the little toe side, toe bending motion is not disturbed even when the toe is bent to move an instep region forwardly as illustrated in FIG. 8(*b*), while a side face and an upper face of a little toe can be covered, the protection of which were not sufficient conventionally.

Further, in the toe cap of the present invention having the extension side wall, the rear end edge of the upper face wall is arranged along a lateral direction approximately perpendicular to the longitudinal direction, and the extension upper wall having an oblique end edge which connects an intermediate position between a section closer to the little toe side than the center of the rear end edge and the side wall at the little toe side with the vicinity of the rear end edge of the extension side wall.

According to the toe cap of the present invention, as a basic shape, since the rear end edge of the upper face wall is arranged along the lateral direction approximately perpendicular to the longitudinal direction the rear end edge can be arranged to a position as far back as possible within the extent that the rear end edge does not disturb the motion of the toe which bends largely toward forward.

Further, by arranging the extension upper wall having the oblique end edge which connects the intermediate position between the section closer to the little toe side than the center of the rear end edge and the side wall at the little toe side with the vicinity of the rear end edge of the extension side wall, toe bending motion is not disturbed even when the toe is bent to move an instep region forwardly as illustrated in FIG. 8(*b*), while a side face and an upper face of a little toe can be covered, the protection of which were not sufficient conventionally.

Further, a shoe of the present invention has a toe cap embedded at a shoe toe to cover a toe region. The toe cap has a cup-shaped shell body formed by connecting a front end wall, bilateral side walls and an upper face wall forming gentle continuously curved faces, and an extension side wall disposed at least at one side wall to form a rear end edge of the side wall to be long rearward from a rear end edge of the upper face wall.

The toe cap embedded shoe according to the present invention protects a toe region locating forward from the base of a thumb like abovementioned shoe and at the same time protects a little toe section with the extension side wall, which could not sufficiently protect by the conventional toe cap as shown in FIG. 4. In addition, according to the toe cap embedded shoe of the present invention, the toe cap does not strongly contact an instep region while protecting the little toe section. Accordingly, walking and toe bending motion are not disturbed.

Further, in the shoe according to the present invention, the rear end edge of the upper face wall of the toe cap is arranged along a direction approximately perpendicular to the longitudinal direction. By forming the rear end edge of the upper face wall of the toe cap along the direction approximately perpendicular to the longitudinal direction, it becomes possible to position the rear end edge at a position as far back as possible. Accordingly, shoe bending is not disturbed while the toe cap covers a large area of the toe region.

Further, in the toe cap embedded shoe according to the present invention, a section of the rear end edge of the upper face wall extending from an approximate center toward a thumb side is arranged along a direction approximately perpendicular to a longitudinal direction, and an extension upper wall having a curved edge forming an inward arc which connects the vicinity of the approximate center of the rear end edge of the upper face wall or an intermediate position between the vicinity of the approximate center and the side wall at a little toe side with the vicinity of a rear end edge of the extension side wall is provided.

Since the section of the rear end edge of the upper face wall of the toe cap extending from the approximate center toward the thumb side is arranged along the direction approximately perpendicular to the longitudinal direction, the rear end edge can be provided at a position as far back position as possible within an extent that the toe bending motion is not disturbed even when the toe is bent to move the instep region forward as illustrated in FIG. 8(*b*).

Further, by arranging the extension upper wall to have the curved edge which forms the inward arc which connects the rear end edge of the extension side wall with the vicinity of the approximate center of the rear end edge of the toe cap or the intermediate position between the vicinity of the approximate center and the side wall at the little toe side, it becomes possible to form a shoe so that it does not disturb toe bending motion while the side face and the upper face of the little toe are covered of which protection was not sufficient conventionally.

Further, in the toe cap embedded shoe according to the present invention, the rear end edge of the upper face wall is arranged along a lateral direction approximately perpendicular to the longitudinal direction, and an extension upper wall having an oblique end edge is arranged, which connects the vicinity of the rear end edge of the extension side wall with an intermediate position between a section closer to a little toe side than the center of the rear end edge of the upper face wall and the side wall at the little toe side.

According to the toe cap mounted on the toe cap embedded shoe of the present invention, since the rear end edge of the upper face wall is arranged along the lateral direction approximately perpendicular to the longitudinal direction as a basic shape, the rear end edge can be provided at a position as far back as possible within the extent that the rear end edge does not disturb the toe bending motion even when the toe is bent to move the instep region forward as illustrated in FIG. 8(*b*). Further, according to the toe cap embedded shoe of the present invention, the toe cap has the extension upper wall having the oblique end edge which connects an intermediate position between the section being closer to the little toe side than the center of the rear end edge and the side wall at the little toe side with the vicinity of the rear end edge of the extension side wall, a side face and an upper face of a little toe, of which protection was not sufficient conventionally, can be covered and protected without disturbing toe bending motion

Effects of the Invention

The toe cap having the extension side wall and the shoe to which the toe cap is embedded according to the present invention has an effect to be able to protect a toe sufficiently even when an impact is applied from the outer side (i.e., the little toe) of the toe, the protection of which was not sufficient in a conventional toe cap embedded shoe. Further, the toe cap and toe cap embedded shoe according to the present invention has an effect not to disturb foot bending motion while the toe is protected against the impact from the outer side as described above.

BRIEF DESCRIPTION OF THE DRAWINGS

FIG. 2(*b*) is an explanatory view illustrating another example of the toe cap according to the present invention.

FIG. 6(*b*) is an explanatory view (i.e., a rear view) indicated in Japanese Industrial Standards.

FIG. 7(*b*) is a sectional side view of the other example of the toe cap according to the present invention. FIG. 7(*c*) is a rear view of the other example of the toe cap according to the present invention.

FIG. 8(*b*) is an explanatory view regarding a state of use of the other toe cap according to the present invention.

FIG. 9(*b*) is an explanatory view illustrating relation between a foot and the toe cap as viewing from the upper side. FIG. 9(*c*) is an explanatory view illustrating relation between a foot and a bottom portion of the toe cap. FIG. 9(*d*) is an explanatory view illustrating relation between a foot and a bottom portion of a conventional toe cap.

FIG. 10(*b*) is an observation photograph of the shoe back with the pedoscope. FIG. 10(*c*) is an observation photograph of the shoe back with the pedoscope.

FIG. 11(*b*) is an explanatory view illustrating the pedoscope from the front. FIG. 11(*c*) is an explanatory photograph of the pedoscope taken from an oblique direction. FIG. 11(*d*) is an explanatory photograph of the pedoscope taken from the above. FIG. 11(*e*) is an explanatory photograph of a state that a person is on the pedoscope. FIG. 11(*f*) is an explanatory photograph of a state that a person is on the pedoscope.

FIG. 12(*b*) is a sectional side view illustrating the example of the toe cap. FIG. 12(*c*) is a plan view illustrating another example of the toe cap.

FIG. 13(*b*) is a plane view illustrating another example of the toe cap according to the present invention.

FIG. 15 is a table showing test results by utilizing the toe cap according to the present invention.

BEST MODE FOR CARRYING OUT THE INVENTION

Figure 1:
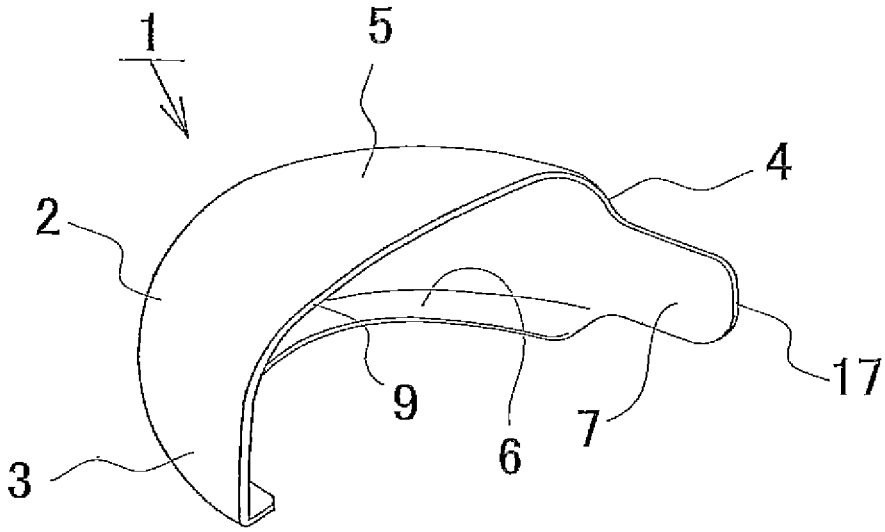
FIG. 1(*a*) is a perspective view of a toe cap according to the present invention and FIG. 1(*b*) is a perspective view illustrating another example of the toe cap according to the present invention.
Figure 1:
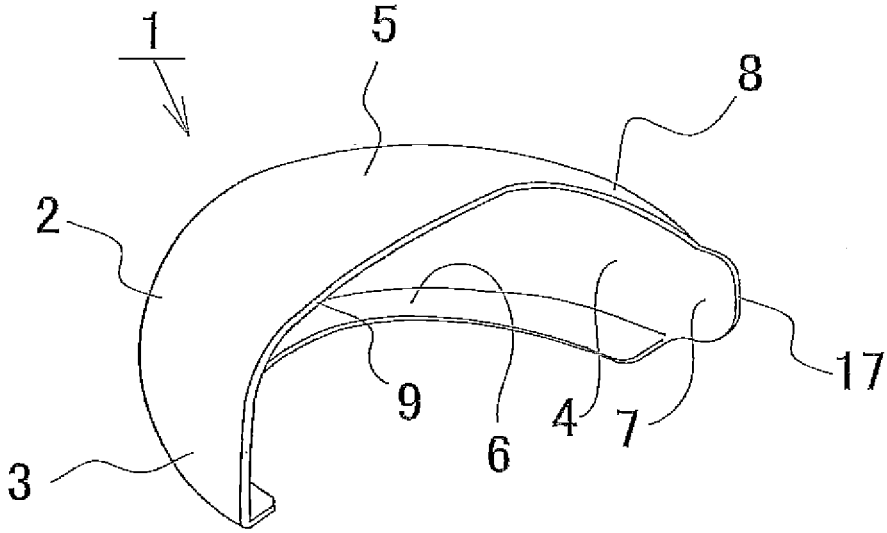

Embodiments for carrying out the present invention will be described below. FIG. 1(*a*) is a perspective view illustrating a toe cap of an embodiment according to the present invention. FIG. 1(*a*) illustrates a toe cap 1, as an example, formed as a steel-made toe cap which is made of steel.

The illustrated toe cap 1 is formed for a right foot. A toe cap for a left foot is to be formed in a shape being bilaterally symmetric with the illustrated toe cap. The toe cap 1 is formed to be a cup-shaped (i.e., dome-shaped) shell body having a front end wall 2, a left side wall 3, a right side wall 4 and an upper face wall 5 forming a gentle continuous curved surface. Thickness of the shell body is approximate 1 to 2 mm and an accommodation space for accommodating a toe is provided at the inside of the shell body.

Here, in this specification, the words "front (toe)", "rear", "left", "right", "inner", "outer", "upper", "lower", "bottom", and the like indicate the orientation, posture and location shown on the basis of a person who wears a shoe.

The toe cap 1 according to the present invention is formed in compliance with JIS T8101 of Japanese Industrial Standards (JIS). The JIS standards define three categories of safety shoe embedded with a toe cap at a toe based on work segments. They are H-class for heavy work, S-class for normal work and L-class for light work. According to the standard, it is defined that an entire surface of a toe cap should be finished smoothly, edges and corners should be rounded, rust-proof treatment should be performed on the entire surface when made of steel. Furthermore, it is defined that; (a) Horizontal distance a between a rear-end central part of an arch and a frontmost end part should be in a range between 40 and 60 mm for H-class and S-class and between 30 to 50 mm for L-class. (b) Height b at a rear-end rearmost part should be 33 mm or higher for H-class and S-class and 28 mm or higher for L-class. (c) A low-side fold part should be folded to be approximately horizontal and width c of a horizontal bottom side should be 3 mm or wider. Dimension values a, b, and c used in the above definition of JIS are those illustrated in FIG. 6 respectively.

Here, although the toe cap according to the present invention is formed to satisfy the JIS standards for H-class as an example, it is also possible to form for S-class and L-class. The toe cap according to the present invention can be adopted for a protective sneaker of an athletic shoe type, a general work shoe and a boot etc., and can be utilized as a toe retainer for a business shoe etc., in addition to a safety shoe satisfying the JIS standards.

At lower ends of the front end wall 2, the left side (i.e., the inner side) wall 3 and the right side (i.e., the outer side) wall 4A, there is provided fold portion 6 having a predetermined width and folded inward. The fold portion 6 is generally called a skirt and it is provided to improve strength and reduce sinking of the toe cap 1 against a shoe bottom.

In addition to the above structure, the toe cap 1 according to the present invention has a structure characterized in that an extension side wall 7 is provided which is formed by extending a rear end edge 17 of at least one side wall rearward against a rear end edge 9 at a center position of the upper face wall 5. As a preferable example, the extension side wall 7 is provided at the right side wall 4 which is the side wall of a little toe side facing outside.

Figure 4:
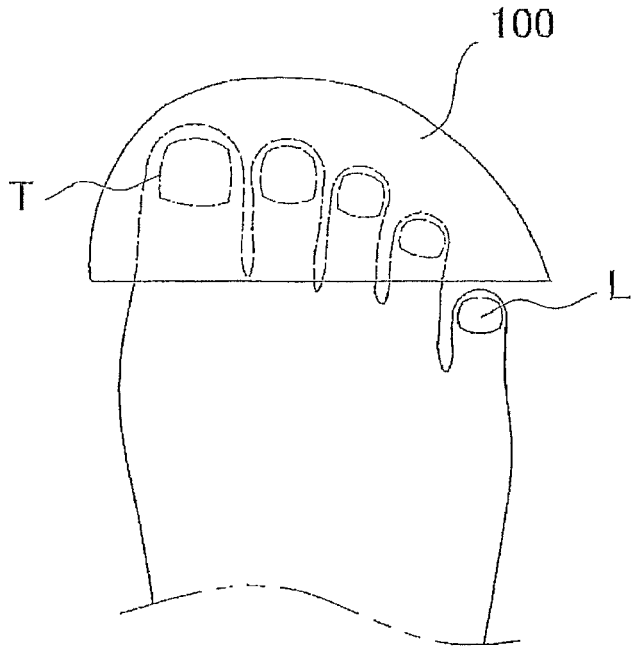
FIG. 4 Prior Art
FIG. 4 is an explanatory view illustrating relation between a conventional toe cap and a foot.

A conventional common type toe cap illustrated in FIG. 4 has an opening formed by the rear end edge 9 through which a toe enters, provided at an approximate center position between a ball of a thumb and a front of the thumb. The opening is formed approximately perpendicular to the longitudinal direction of the shoe and on a plane which stands at a right angle or slightly frontward tilted angle to a shoe bottom face. In the shoe having the conventional toe cap, as illustrated in FIG. 4, although the toe cap 100 can cover a region around the thumb, a little toe L located at a retreated position from the thumb is protruded from the toe cap. Accordingly, the conventional toe cap 100 could not protect the toe sufficiently in a case that a narrow object such as a wheel of a dolly hit the little toe L uncovered by the toe cap from a lateral direction.

Figure 2:
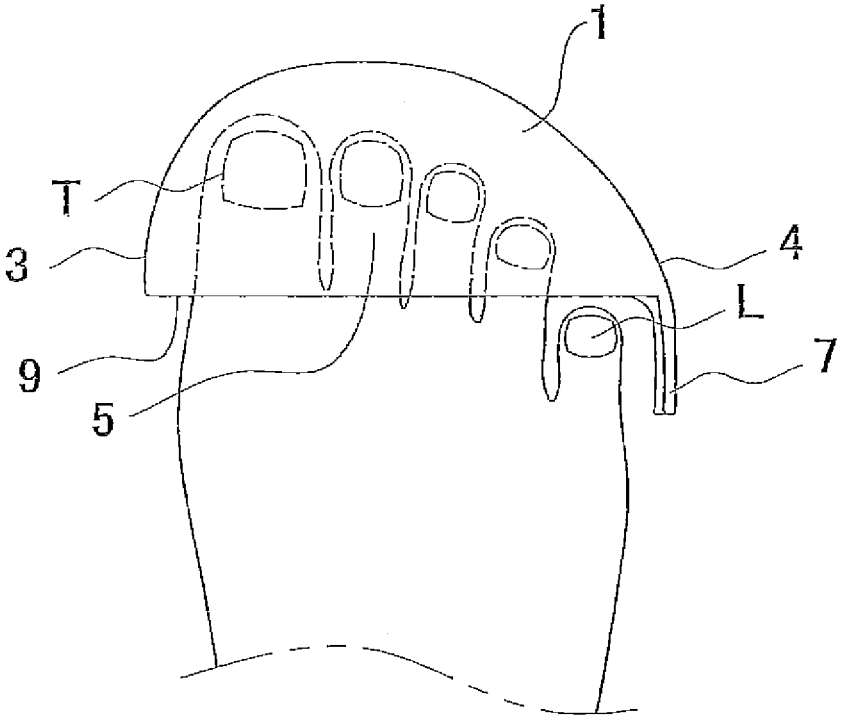
FIG. 2(*a*) is an explanatory view illustrating relation between the toe cap according to the present invention and a foot.
Figure 2:
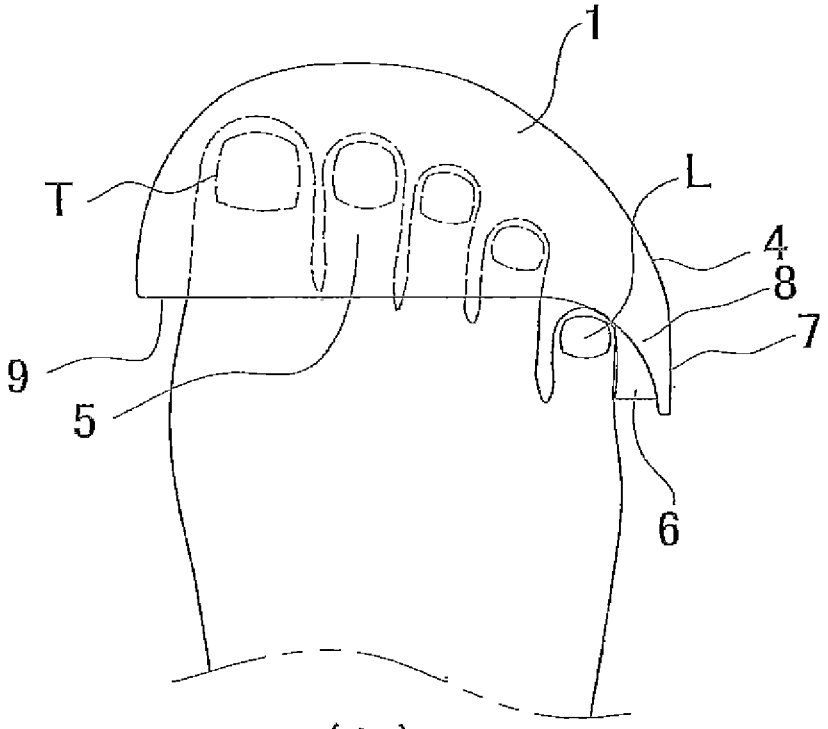

FIG. 2(*a*) is an explanatory view illustrating the relation between a toe and a toe cap 1 in the state where a shoe is worn. Even though the shape of a toe differs in each person, the little toe L is usually located at a position retreated from the thumb T. As described above, the toe cap 1 according to the present invention is provided with the extension side wall 7 at the side thereof. The extension side wall 7 is an approximately rectangle-shaped projection piece capable of covering the little toe L sufficiently in both length and height from the side. The extension side wall 7 illustrated in FIG. 2(*a*) is formed to open above the little toe L almost entirely and not to have the fold portion 6 below the little toe L, which forms the skirt Similar to the conventional toe cap, the foot-inlet opening of the toe cap 1 formed by the rear-end edge 9 except for the extension side wall 7 is located at an approximate central position between a ball of a thumb and a front of the thumb and is formed approximately perpendicular to the longitudinal direction of the shoe and on a plane which stands at a right angle or slightly frontward tilted angle to a shoe bottom face.

Here, as illustrated in FIGS. 1(*b*) and 2(*b*), it is also possible to provide a curved approximately triangle-shaped upper small wall (i.e., an extension upper wall) 8 above the little toe L for covering the upper part of the little toe L across an upper end of the extension wall 7 and the upper face wall 5. Further, it is also possible to provide the fold portion 6 below the little toe L, which is extension of the skirt. The shape and size of the upper small wall 8 and the extended fold portion 6 are determined in consideration of foot comfort involved in toe bending and flexibility of shoe bottom and shoe instep required for walking and working.

Figure 5:
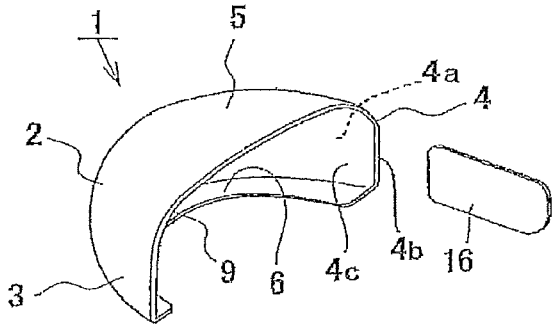
FIG. 5 is an explanatory view illustrating another example of the toe cap according to the present invention.

Here, it is also possible to form the extension side wall 7 in FIG. 1 by a separate member different from the toe cap 1. For examples, as illustrated in FIG. 5, it is possible to prepare a side wall 16 fix it to a part (i.e., an outer face 4*a*, a rear end 4*b* or an inner face 4*c*) of the right side wall 4 of the toe cap 1. The method of fixing includes fixing with adhesive, fixing by welding, fixing by arranging an engaging portion and an engaged portion respectively at the right side wall 4 and side wall 16 (e.g., fitting between a concave portion and a convex portion), and fixing by screwing as arranging a penetration hole respectively at the right side wall 4 and the side wall 16.

Figure 3:
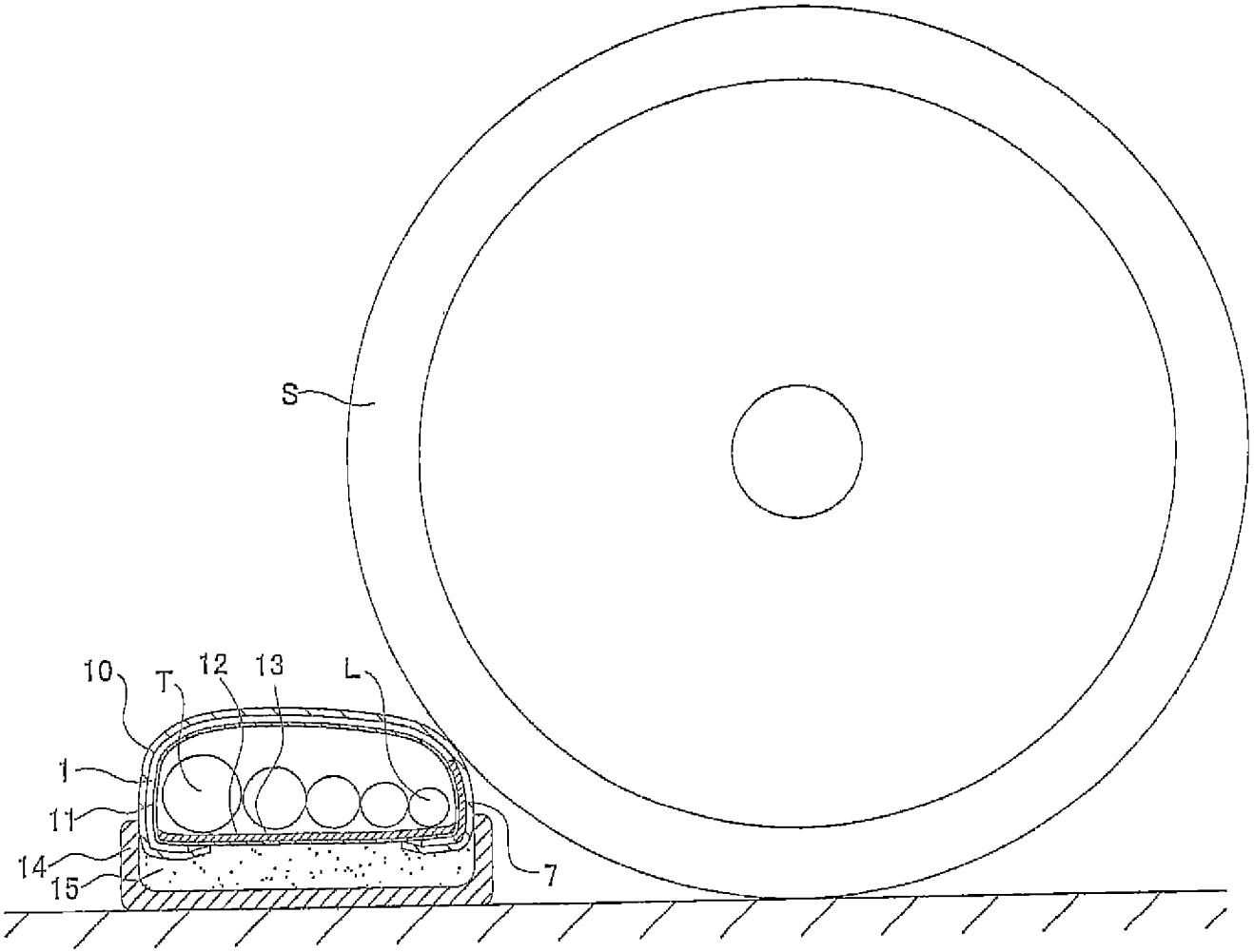
FIG. 3 is an explanatory view illustrating relation between the toe cap according to the present invention and a foot.

FIG. 3 is an explanatory view illustrating the relation between a sectional view of the shoe toe at the vicinity of the side part to which the extension side wall 7 is provided and a wheel S, the diameter of which is 20 cm and the withstanding load is 300 kg. The shoe illustrated in the drawing consists of an instep top 10, the toe cap 1, a toe underlining 11, a sock-liner (i.e., an insert) 12, an inner sole 13, a mid-sole 15, an out-sole 14, and the like.

In general, a dolly has wheels S at four corners below a pallet. Accordingly, in most cases, a toe collides with the wheel S when a dolly hits a foot. This is because a region close to an ankle is likely to be contacted by an edge of the pallet prior to the wheel and is unlikely to be contacted by the wheel while the toe could enter below the pallet. In particular, the outside of the toe is more likely to be contacted to the wheel S. That is, the little toe side of the toe has the highest possibility of being contacted to the wheel S.

The relation between the wheel S and the toe is illustrated in FIG. 3. It is understood that the extension side wall 7 prevents direct contact between the little toe L and the wheel S.

A wheel of a hand dolly loaded heavy burden rarely runs over the little toe L beyond the extension side wall 7. Normally, since the dolly is operated by a person, the speed thereof is slow when a heavy load is mounted on the dolly. Therefore, the dolly does not gain force such that the wheel runs on the toe while lifting the dolly. When the wheel hits the shoe toe, the shoe toe is sandwiched between the wheel and a floor face as a wedge and stops the dolly like a wheel stopper.

On the contrary, when the load mounted on the dolly is light and the speed of the dolly is high, there may be a case that the wheel runs over the toe. However, in this case, since the load exerted on the little toe L from the above is relatively small, the possibility of being injured is small. Further, a lateral impact is blocked by the toe cap 1 (i.e., the extension side wall 7). As described above, injury at the toe can be prevented or lessened in either case of the above.

Further, in a case that the abovementioned upper small wall (i.e., the extension upper wall) 8 is provided, the strength of the extension wall 7 itself is improved. It also protect the little toe by slightly covering the upside thereof. Accordingly, the vicinity of the little toe can be protected from the wheel which runs over.

Here, even when the upper portion of the vicinity of the little toe is opened, the vicinity of the little toe is surrounded by an upper edge of the extension side wall 7 and the upper face wall 5 or an upper edge of a later-mentioned extension side wall 26 and an upper face wall 24. Accordingly, except for a case that a pin-head-like object is stuck from the above in the vicinity of the little toe, it is possible to prevent the load of a fallen object of a certain size or a run-over of dolly from directly being applied to the vicinity of the little toe owing to the support by the upper edge of the extension side wall and the upper face wall. Further, the section surrounded by the upper edge of the extension side wall and the upper face wall is a section surrounded by the shoe instep top and since it is capable of supporting a certain amount of load, the instep top contributes to the protection of the vicinity of the little toe.

FIG. 15A shows the result of a test in which a hand dolly is collided from the little toe side (i.e., laterally) against the shoe having the toe cap 1 illustrated in FIG. 2(*b*) is embedded.

In this test, the height of the extension side wall 7 of the toe cap 1 is set to be 20 mm and moving speed of the dolly is adjusted to three steps to be a normal walking level (i.e., 1.4 m/sec), a slow walking level (i.e., 1.0 m/sec), and an extremely slow walking level (i.e., 0.6 m/sec). Then, it was examined whether or not the wheel S of the dolly runs over the upper face of the shoe at each moving speed.

Further, the weight of burden loaded on the dolly was increased by 50 kg from 50 to 300 kg, and then, it was examined whether or not the wheel S runs over the upper face of the shoe at each weight and at each speed.

In a table indicated in FIG. 15, description of "run-over" is given when the wheel S runs over the shoe beyond the extension side wall 7, and description of "not run-over" is given when the wheel S was stopped without exceeding the extension side wall 7 or was bounced back to the side opposite to the moving direction.

As a result of this test, it was concluded that the wheel S does not exceed or run over the extension wall 7 at any moving speed. Accordingly, it is determined that the toe cap 1 according to the present invention can sufficiently protect a toe even when an impact is applied from the outside (in particular, the little toe side) direction of the toe.

As described above, the toe cap having the extension side wall and the shoe having the toe cap embedded according to the present invention can sufficiently protect a toe even when an impact is applied from the outside (in particular, the little toe side) direction, which is not protected sufficiently with a working shoe having a normal toe cap embedded.

Here, when protection of a toe is focused, it is sufficient to utilize a large toe cap which covers the entire toe and instep top region. However, in such a case, working and walking are disturbed due to incapability of toe bending. The present invention intends to provide the toe cap (i.e., the toe cap embedded shoe) having the extension side wall capable of substantially protecting the entire toe including all toe fingers and to provide means with similar operational effects as the extension side wall without causing disturbance for working and walking. Accordingly, means having substantially same operation and effects as the means according to the present invention is substantially within the technical scope of the present invention even if the shape thereof is different from the shape described in the above embodiments.

Here, a side wall similar to the extension side wall 7 disposed at the inner side (i.e., the thumb side) for protecting the inner side (i.e., the thumb side) depending on the intended use is within the technical scope of the present invention. Further, the material for the toe cap is not limited to steel material. Synthetic resin such as polycarbonate may be utilized as the material for the toe cap.

Figure 7:
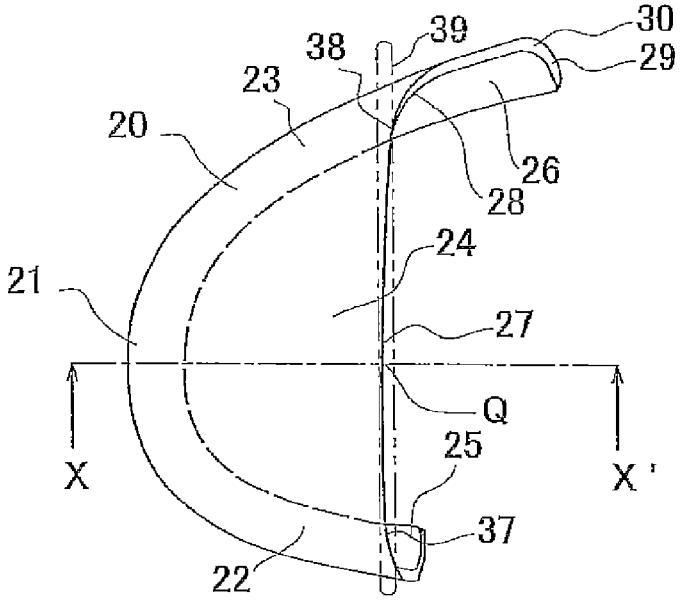
FIG. 7(*a*) is a plane view of another example of the toe cap according to the present invention.
Figure 7:
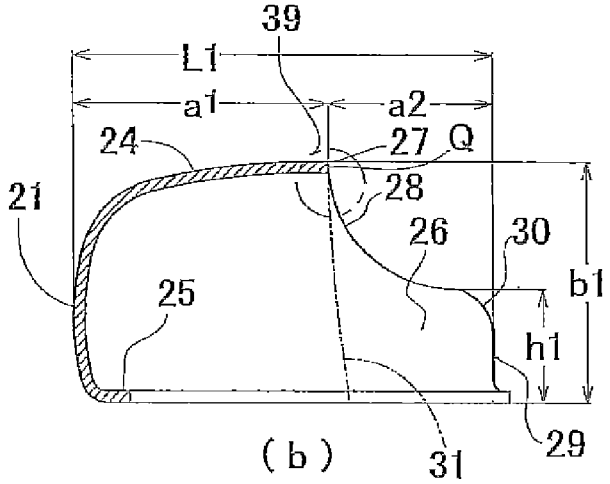
Figure 7:
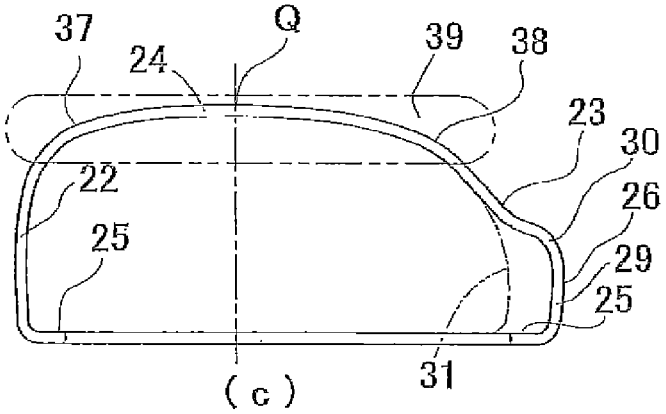

FIGS. 7(*a*), 7(*b*) and 7(*c*) are explanatory views illustrating an appropriate example of the toe cap of the present invention. FIG. 7(*a*) is a plan view of a toe cap 20. FIG. 7(*b*) is a sectional view at line X-X' of the toe cap 20 illustrated in FIG. 7(*a*). FIG. 7(*c*) is a rear view. The respective drawings are explanatory views showing the toe cap for a right foot. A structure of the toe cap 20 for a right foot will be described below. Here, a toe cap for a left foot is to be formed in a shape as inverting the toe cap 20 in a bilaterally symmetric manner. There is no technical difference therebetween.

Similar to the toe cap 1 as mentioned above, the toe cap 20 illustrated in FIG. 7 has a front end wall 21, a left side wall 22, a right side wall 23, an upper face wall 24, a low-side fold portion 25, an extension side wall 26 and a rear end edge 27. The toe cap 20 has a dome-shaped shell body (hereinafter, called a main body portion) which satisfies the requirements defined for H-class (for heavy operation) of the JIS standards and the extension side wall 26 is disposed to the main body portion.

The total length L1 of the toe cap 20 including the extension side wall 26 illustrated in FIG. 7 is in a range between 60 mm and 80 mm. A length a1 from the front end wall 21 to a center Q of the rear end edge 27 is approximately between 40 mm and 50 mm. A length a2 from the center Q of the rear end edge 27 to a distal end of the extension side wall 26 is approximately between 20 mm and 30 mm in the side view.

Here, the center Q of the rear end edge 27 denotes the vicinity of intermediate point in the lateral direction of the main body portion or the vicinity of a position on the rear end edge 27 where the distance from the front end wall 21 of the main body portion to the rear end edge 27 is the longest.

The extension side wall 26 includes a curved portion 28 curved inward as smoothly lowered from a boundary (indicated by two-dotted chain line 31) with the main body portion and a rear end face 29 approximately perpendicular to the bottom face. A section between the curved portion 28 and a corner portion 30 has approximate predetermined height h1 from the bottom face. The corner portion 30 is an outer edge curved outward. Here, the section having the height h1 may be formed as a continuous curved line from the curved portion 28 toward the corner portion 30 or as a straight portion in parallel to the bottom face as long as functioning as the extension side wall.

As an example, the height h1 of the extension side wall 26 is formed to be about a half of the total height b1. Since the total height b1 for H-class of the JIS standards is 33 mm or higher, the height h1 of the extension side wall 26 of the present embodiment is to be 16.5 mm or higher and the toe cap 20 of the present embodiment is formed to have a height of about 20 mm. The height is determined in consideration of the structure of a shoe to be attached, such as thickness of the shoe sole and the sock liner and is determined to exceed the height of little toe of a foot to be accommodated.

FIG. 7(*b*) is a lateral sectional view and mainly illustrates shapes of the right side wall 23 and the extension side wall 26 disposed continuously to the right side wall 23. The line 31 indicated by a two-dotted chain line denotes an imaginary boundary line between the main body portion being the dome-shaped shell body and the extension side wall 26, which is seen overlapped at approximately the same position with an opening edge of the left side wall 22 located at the opposite side in the side view.

The rear view of the toe cap 20 having the extension side wall 26 as illustrated in FIG. 7(*c*) appears to have an extension portion at the right side. The section appears to be extended is the extension side wall 26. Since the extension side wall 26 is arranged to hang out obliquely rearward of the main body portion, the shape appears in the rear view to be extended to the right. Further, the section indicated by the line 31 using a two-dotted chain line in FIG. 7(*c*) denotes the rear end edge of the main body portion. The position thereof is approximately close to the position of the rear end edge of the conventional toe cap to which the extension side wall is not disposed.

Figure 6:
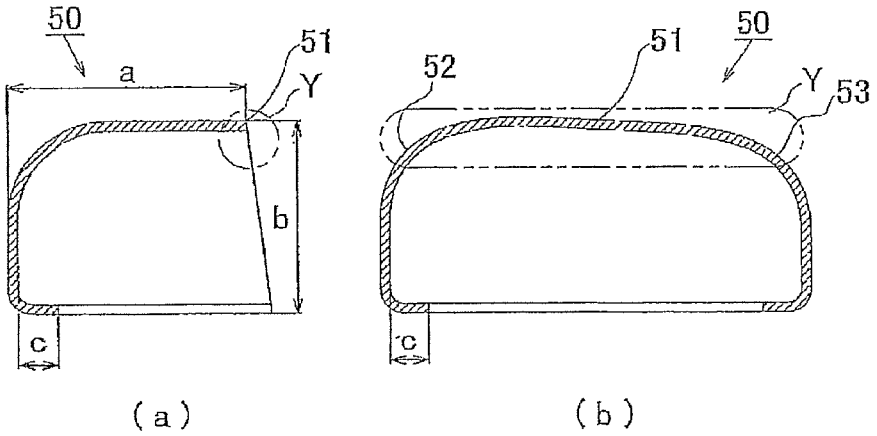
Prior Art FIG. 6
FIG. 6(*a*) is an explanatory view (i.e., a sectional side view) indicated in Japanese Industrial Standards.

The shape of the rear end edge 27 of the upper face wall 24, like a rear end edge Y of a toe cap 50 illustrated in FIG. 6, is formed by an upper edge formed into a gentle arc along the bilateral direction, an inner side shoulder portion 37 and an outer side shoulder portion 38 which are smoothly lowered continuously at the bilateral both side walls respectively.

The position and shape of the rear end edge 27 of the upper face wall 24 are important elements for a shoe to which toe cap is embedded. For example, when the rearward hang-over amount of the rear end edge 27 becomes large in a conventional toe cap, an instep contacts the rear end edge 27 even when the toe portion is slightly bent. Accordingly, the position and shape of the rear end edge 27 disposed to the main body portion of the toe cap are important elements for a working shoe.

In case of manufacturing working shoes suitable for feet of Japanese persons, toe caps to be embedded are adopted in consideration of the dimensions determined by proportionally increasing and decreasing the dimensions defined by the JIS standards for respective shoe sizes corresponding to foot sizes. Accordingly, it is possible to form the main body portion of the toe cap which is fitted to a foot of a Japanese person without strong contact between the instep and the rear end edge 27 at the time of bending of the toe portion. The strength as the toe cap required for the main body portion and the degree of contact between the instep and the rear end edge 27 at the time of bending are similar to those with the conventional toe cap illustrated in FIG. 6.

Further, in a case that safety standards similar to the above-mentioned JIS standards exist in countries other than Japan, toe caps and working shoes are formed to satisfy the safety standards of the respective countries.

Figure 14:
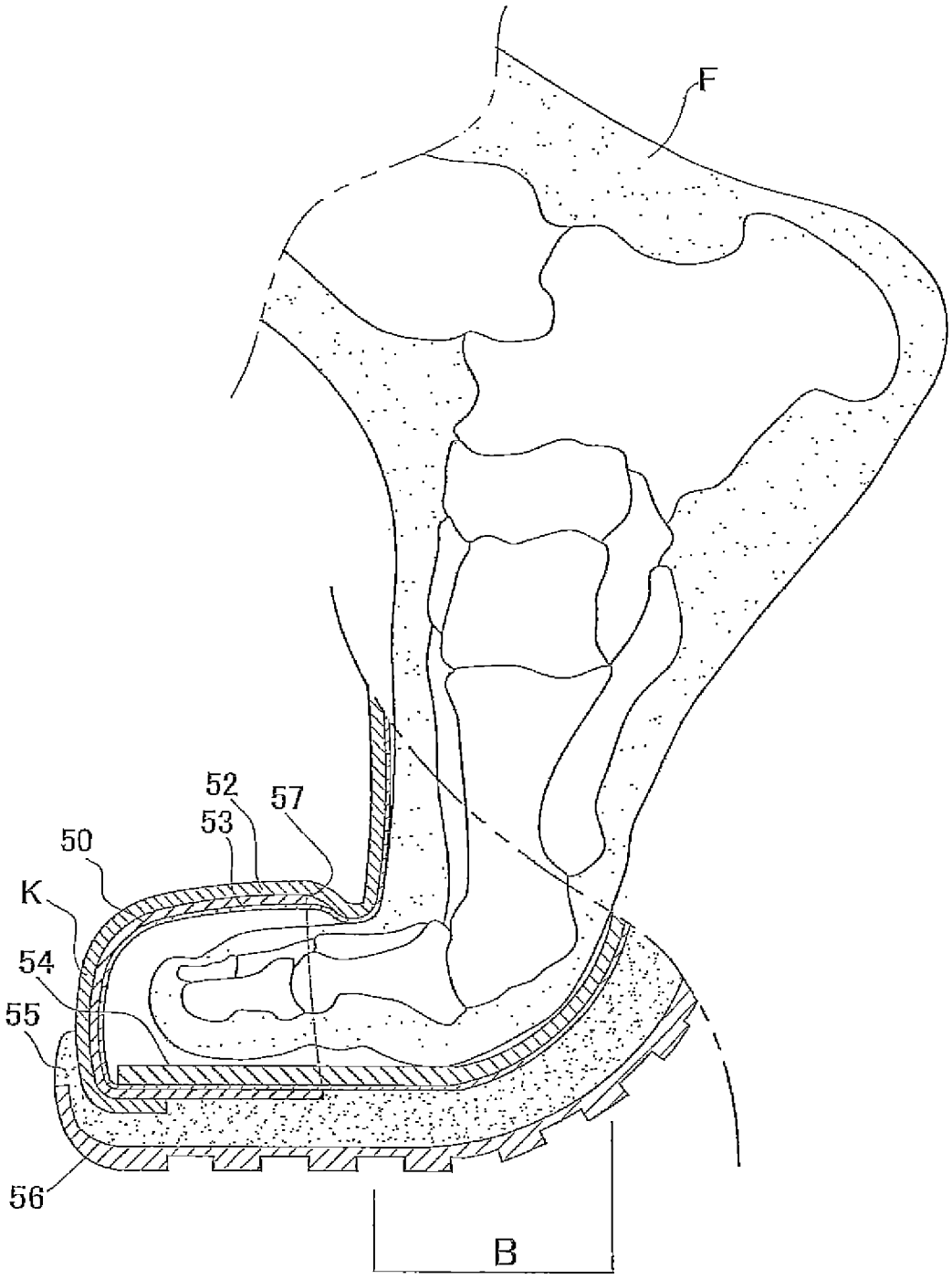
FIG. 14 is a sectional side view illustrating a state of use of a conventional toe cap.

FIG. 14 is an explanatory view illustrating the relation between a shoe K in which the conventional toe cap 50 is embedded and a foot F with a sectional view of the toe. The shoe K is constituted with an instep top 52, a toe underlining 53, a sockliner (i.e., an insert) 54, a mid-sole 55 and an out-sole 56.

In case of the conventional toe cap 50 which is appropriately formed based on the JIS standards, the shoe toe can be bent to a degree so that a sole is to be at a right angle against a walking surface. That is, the instep portion is not to be contacted to the rear end edge 57 even when the toe is largely bent.

The toe cap 20 according to the present embodiment is enhanced in protection of the outer side (in particular, the little toe side) face without impairing toe bending characteristics and foot comfort which the conventional toe cap 50 as illustrated in FIG. 14 has.

Here, structural features of the toe cap 20 will be described once again. The toe cap 20 has a structure illustrated in FIG. 7. The extension side wall 26 is disposed to project rearward at the right side wall 23 being at the little toe side (i.e., the outer side) of the main body portion.

The rear end edge 27 of the upper face wall 24 is contoured to form a smooth arc along the bilateral direction. The inner side shoulder portion 37 is formed between the left side (i.e., the inner side) wall 22 and the rear end edge 27 to connect them and decline smoothly. The outer side shoulder portion 38 is formed between the right side (i.e., the outer side) wall 23 and the rear end edge 27 to connect them and decline smoothly. The shape of an upper edge portion 39 comprising the rear end edge 27, the inner side shoulder portion 37 and the outer side shoulder portion 38 to be continuous is an important shape for the toe cap 20 of the embodiment of the present invention. The shape of the upper edge portion 39 is similar to the same portion of the conventional toe cap which is appropriately formed. Accordingly, the toe cap 20 does not contact the instep region even if the foot is bent frontward forcefully, so that toe bending motion is not disturbed as in the case of the example illustrated in FIG. 14.

Figure 8:
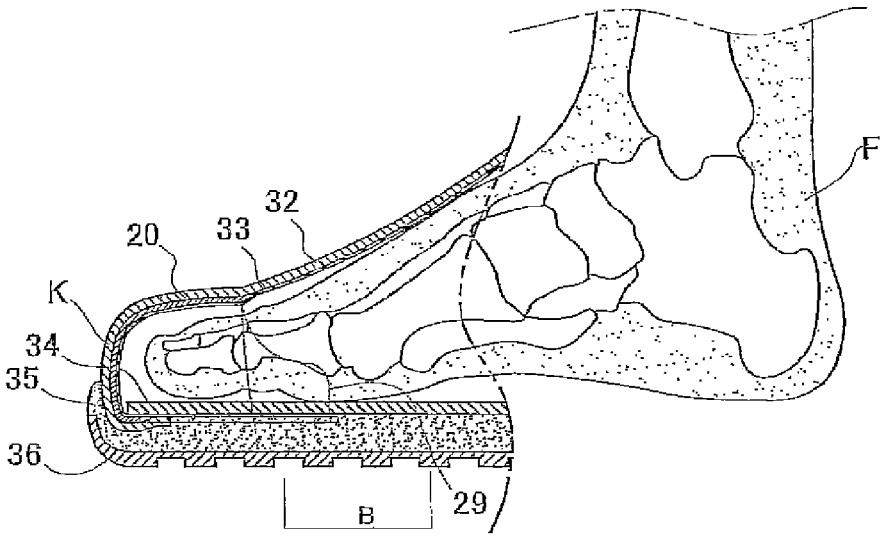
FIG. 8(*a*) is an explanatory view regarding a state of use of another toe cap according to the present invention.
Figure 8:
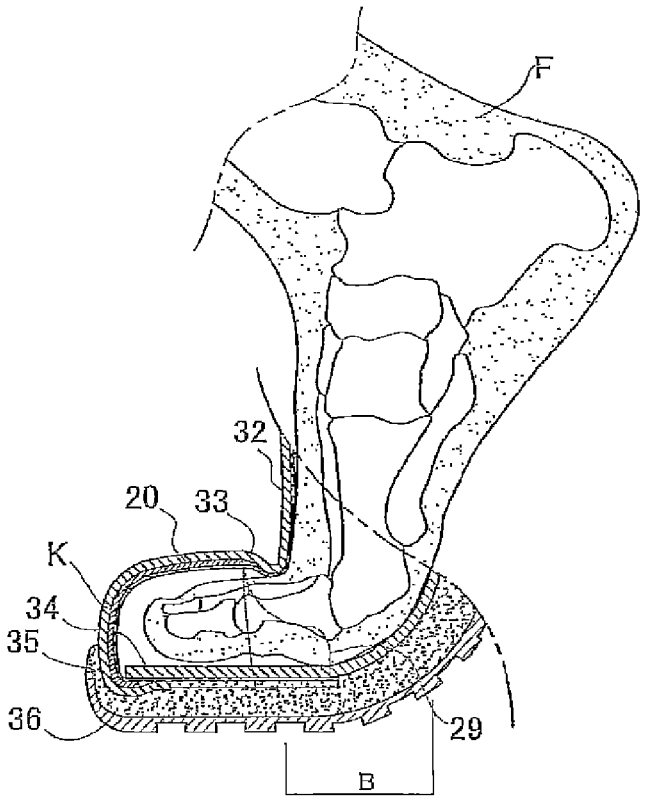

Meanwhile, in order not to disturb bending of the toe (i.e., shoe toe), the shape of the bottom portion of the toe cap 20 is important as well as the shape of the upper edge portion 39. FIG. 8(*a*) illustrates a sectional view of a shoe toe portion of the shoe K in which the toe cap 20 is embedded. The shoe K comprises an instep top 32, a toe underlining 33, a sockliner (i.e., an insert) 34, a mid-sole 35, and an out-sole 36 as main components. FIG. 8(*b*) illustrates a state that the toe portion of the shoe K is bent.

Figure 9:
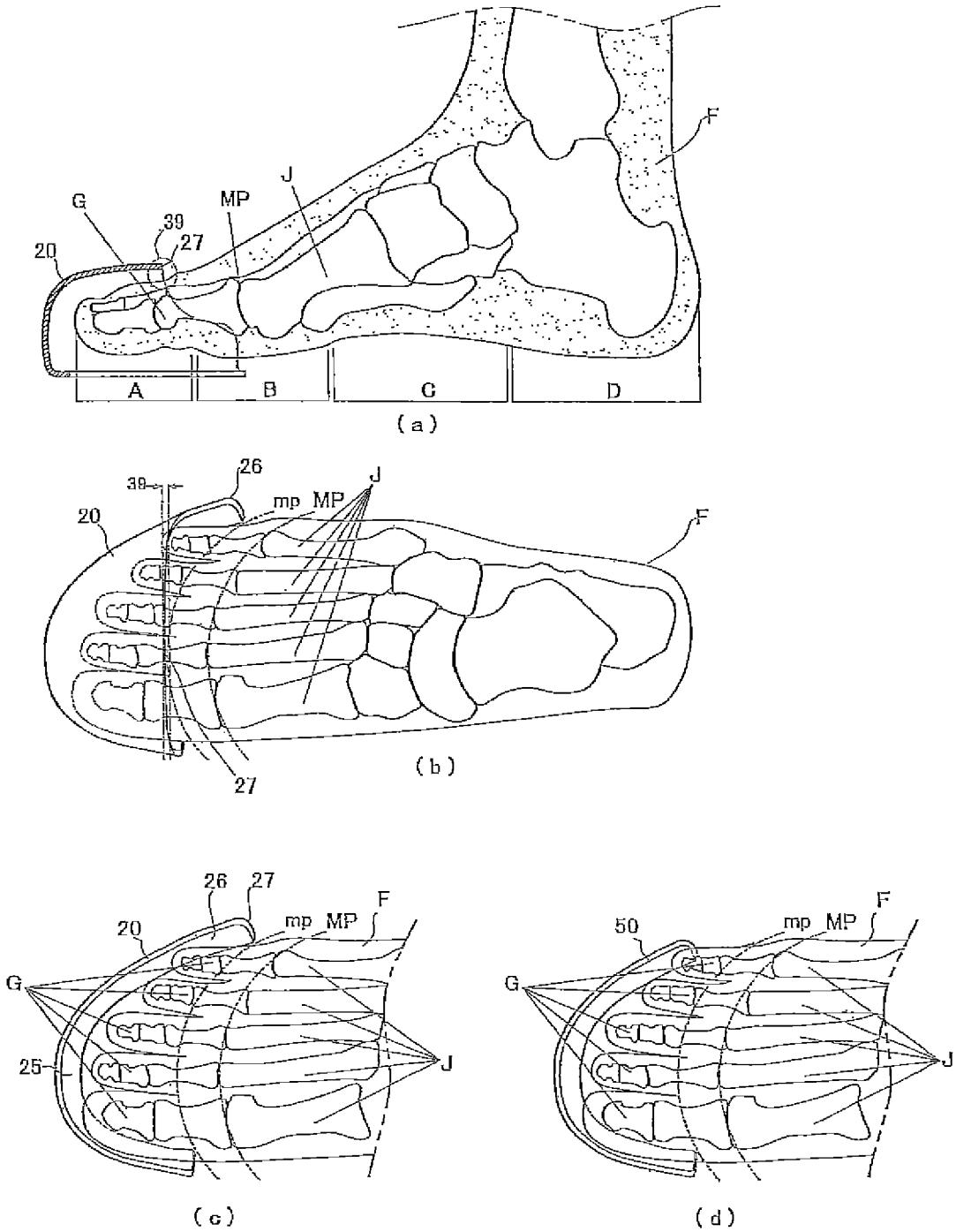
FIG. 9(*a*) is a sectional view illustrating relation between a foot and the toe cap as viewing form a side.

FIGS. 9(*a*) to 9(*c*) are explanatory views respectively illustrating the toe cap 20 illustrated in FIG. 8(*a*) and only a toe of a foot F. FIG. 9(*a*) is a lateral sectional view. FIG. 9(*b*) illustrates the relation between the rear end edge 27 of the upper wall of the toe cap 20 and the toe portion of the foot F. FIG. 9(*c*) is an explanatory view illustrating the relation between the bottom face of the toe cap 20 and the toe of the foot F. Here, FIG. 9(*d*) is a plan view, viewed from the upper side, illustrating the relation between the conventional toe cap and the toe of the foot F to be utilized for comparison with FIG. 9(*c*).

As illustrated in FIG. 9(*a*), the bottom face of the foot F can be approximately divided into the regions of a toe A, a step portion B, a plantar arch C, and a heel D from the front side. The toe roughly consists of metatarsals J and phalanxes G being a front part from the metatarsals J. A joint connecting the metatarsal J and the phalanx G is called a metatarsal phalanx (MP) joint. In this specification, an imaginary curved line smoothly connecting the respective MP joints from the digitus primus (i.e., the thumb) to the digitus quintus (i.e., the little toe) is called an MP line (MP).

Bending as standing on tiptoe as illustrated in FIG. 8(*b*) is generated mainly having any joint on the MP line as the center, and then, the step portion B close to the bent portion contacts a walking surface and the like.

Although the shoe bottom structure is various, the sockliner 34, the mid-sole 35 and the out-sole 36 are arranged from the inner side of the shoe toward the contact face side in general. When bending is performed so that the sole of the foot to be vertical as illustrated in FIG. 8(*b*), the shoe bottom is naturally bent following the shape of the foot.

If the shoe bottom cannot be bent following the foot shape when the toe is bent, it would disturb to keep the posture of operation and foot exercise. Although a non-bending portion is increased due to the extension side wall 26 is provided, the toe cap 20 according to the present embodiment has bending performance similar to the conventional shoe.

Figure 10A:
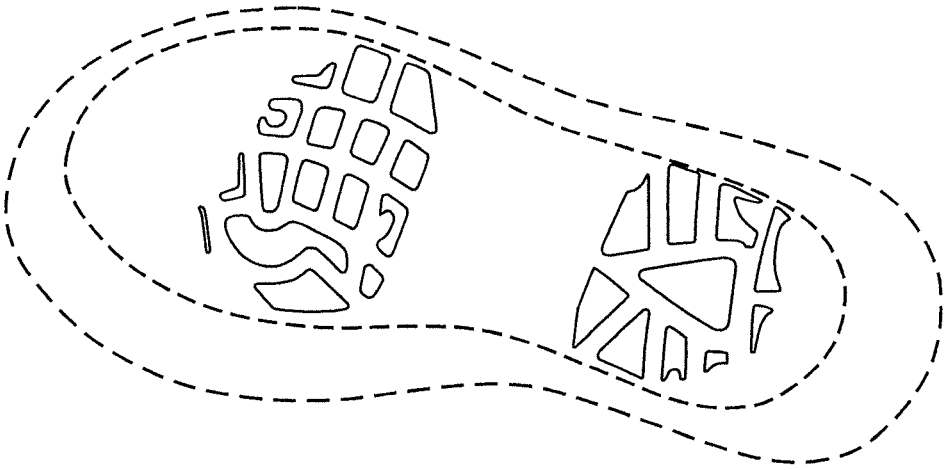
FIG. 10(*a*) is an observation photograph of a shoe back with a pedoscope.
Figure 10B:
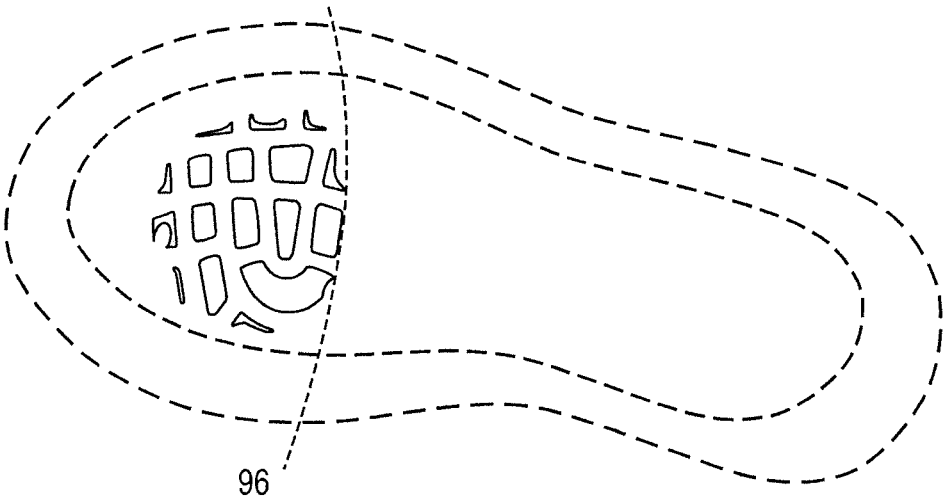
Figure 10C:
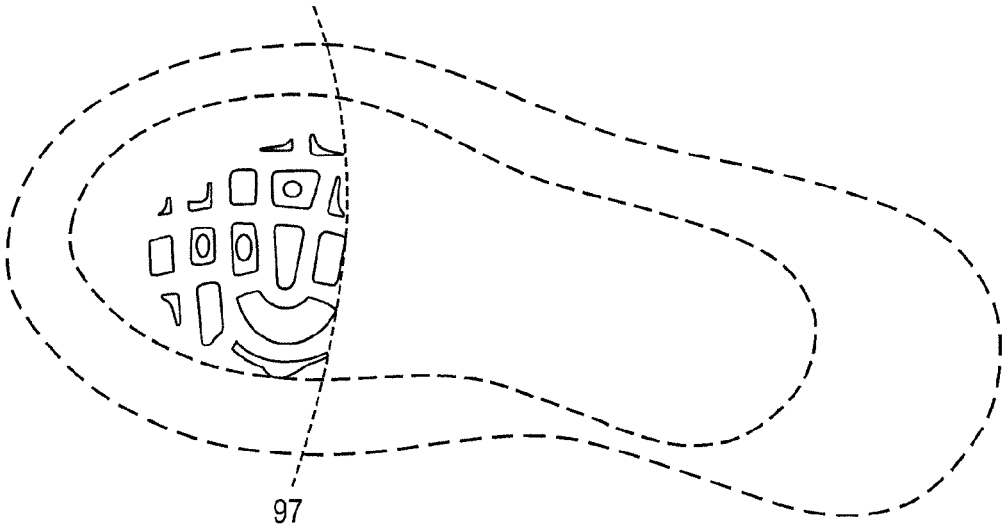
Figure 11A:
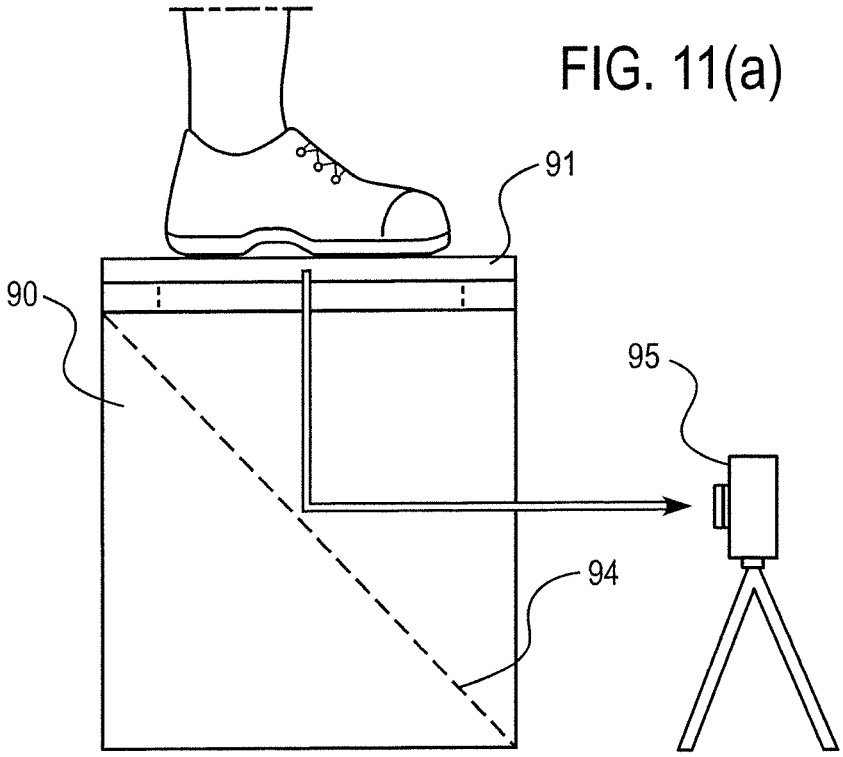
FIG. 11(*a*) is an explanatory view illustrating the pedoscope from a side.
Figure 11B:
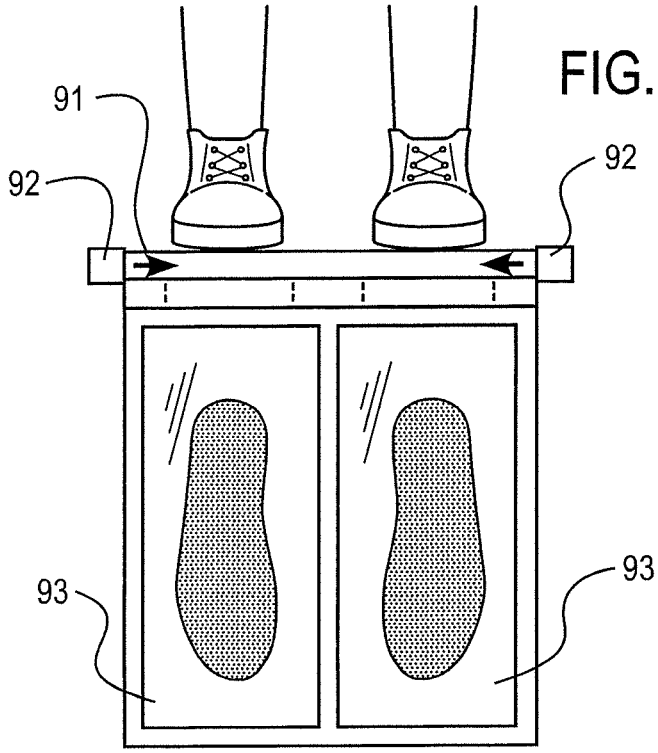
Figure 11C:
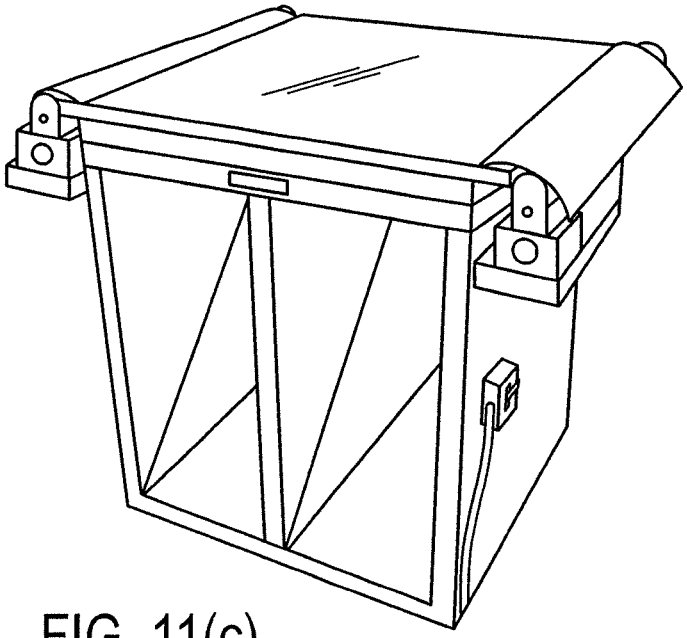
Figure 11D:
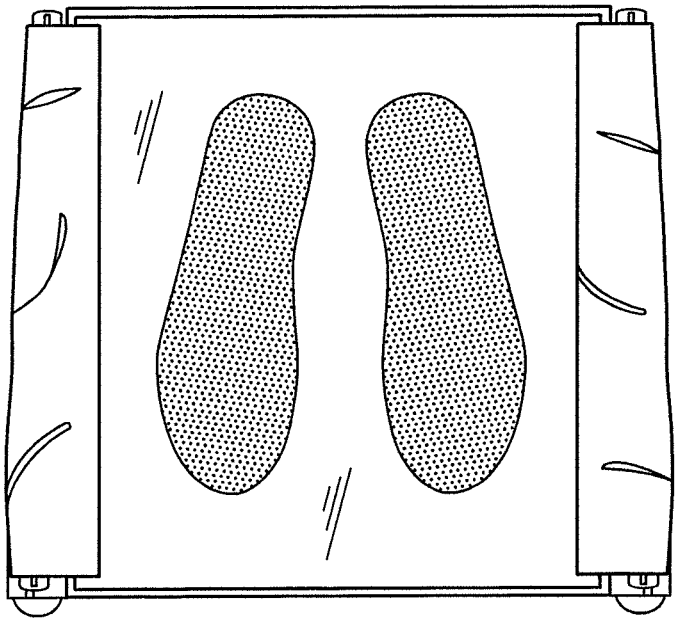
Figure 11E:
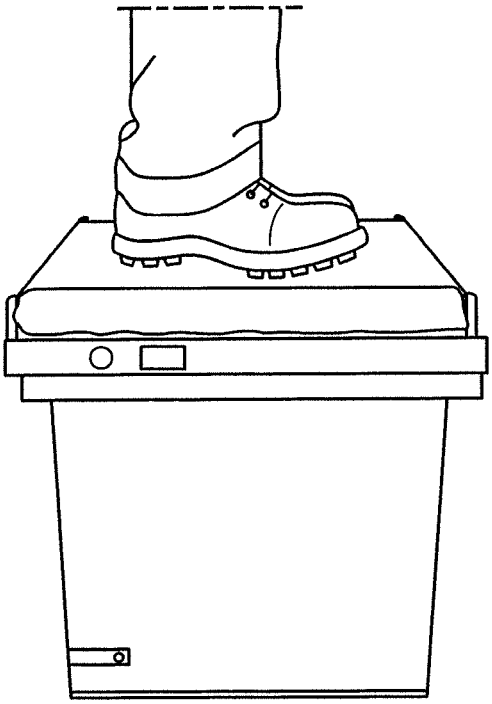
Figure 11F:
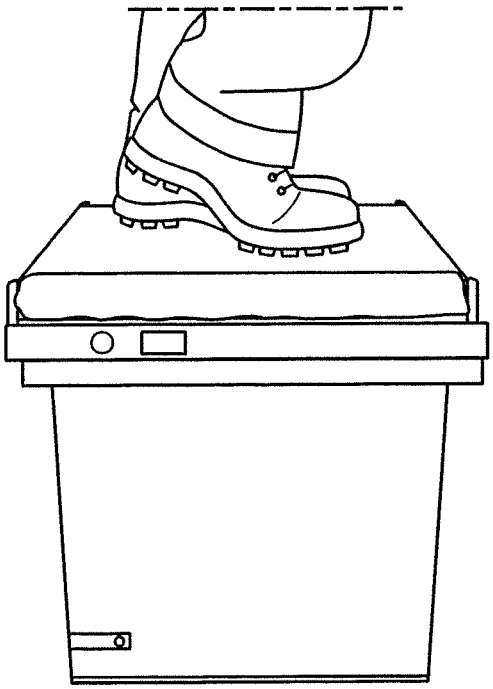

FIG. 10 shows photo images of the shoe bottom surface taken utilizing a pedoscope which brightly illuminates the portions contacting a glass surface to be an observed surface.

FIGS. 11(*a*) to 11(*d*) are explanatory views, explanatory photographs and the like of the pedoscope. The pedoscope 90 used for photographing has a cubic-shaped case and a transparent thick glass plate 91 is disposed as the observation face. A mask plate having cutout which is slightly larger than an external shape of the shoe bottom is attached to the rear face of the glass plate 91, so that light can pass only through the cutout area with the mask plate. The cutout area is separately arranged corresponding to each of the right and left shoes as being aligned in the longitudinal direction. Further, light is evenly irradiated into the glass plate 91 with a light 92 from an end face of the glass plate 91.

A partition wall 93 which separates right and left spaces is arranged at the center in the cube-shaped case, so that the spaces are formed corresponding to the cutout areas for the right and left shoes. Further, the front side of the case is opened and an inclined mirror 94 is arranged frontward from the rear side respectively at the right and left spaces which are separated by the partition wall 93.

As illustrated in FIGS. 11(*e*) and 11(*f*), when a person wearing shoes stands on the above-structured pedoscope 90, shoe bottom faces can be observed through the front opening via the mirror 94. Then, sections which are intimately contacted to the glass plate 91 is irradiated with light diffusing in the glass plate 91 to be bright with reflection. FIG. 10 shows images obtained by photographing the reflected light with a camera 95.

FIG. 10(*a*) shows an image of a bottom face of a shoe to which the toe cap 20 of the present embodiment is embedded as being photographed in a state that a wearing person stands upright against the observation face (i.e., the state of FIG. 11(*e*)).

FIG. 10(*b*) shows an image of the bottom face of the shoe to which the toe cap 20 of the present embodiment is embedded, photographed in a state that the person wearing the shoe lifts the heel while contacting the toe to the observation face with the knee is thrown out (i.e., the state of FIG. 11(*f*)).

FIG. 10(*c*) shows an image of a bottom face of a shoe to which conventional toe cap without the extension side wall is embedded, photographed in a state that the person wearing the shoe lifts the heel while contacting the toe to the observation face with the knee is thrown out, similarly to FIG. 10(*b*).

FIG. 10(*a*) shows the shoe bottom in a state of standing on the pedoscope without bending the shoe toe. As a result of the test, it was observed that approximately the same portions were contacted to the surface of the glass plate 91 regardless of presence or absence of the extension side wall 26. Here, only the photograph of the shoe utilizing the toe cap 20 with the extension side wall is shown in FIG. 10(*a*) and the photograph relating the toe cap without the extension side wall is omitted.

Both of a curved line 96 in FIG. 10(*b*) and a curved line 97 in FIG. 10(*c*) are boundary lines connecting each boundary between a grounded portion and a non-grounded portion. By comparing the both, it can be determined that positions of the boundary lines 96, 97 are approximately the same. This shows that the shoe bottom is bent following the foot shape regardless of presence or absence of the extension side wall. That is, the presence or absence of the extension side wall 26 does not affect foot bending and the shoe to which the toe cap of the present embodiment is embedded has similar bending characteristics as the shoe to which conventional toe cap is embedded.

FIG. 9(*c*) is the explanatory view illustrating the relation between the shape of the toe cap 20 at the vicinity of the shoe bottom and the foot. FIG. 9(*d*) is the explanatory view illustrating the relation between the shape of the conventional toe cap 50 at the vicinity of the shoe bottom and the foot. As described above, bending of the toe portion is performed having the step portion B as the center along the MP line. As can be seen from comparison of FIG. 9(*c*) and FIG. 9(*d*), even though the extension side wall 26 is extended rearward from a portion corresponding to the rear end edge of the conventional toe cap, it is confirmed that the toe cap is existed at a position not to give influence to disturb the bending of the foot in the area along the MP line having the step portion B as the center. It coincides with the observation result utilizing the above pedoscope.

The mp line indicated in FIG. 9(*c*) is an imaginary line drawn by moving the MP line frontward along the longitudinal direction of the shoe until it matches with the front edge portion of the step portion B. The frontmost part of the mp line approximately matches with the position of the rear end edge 27 (i.e., the upper edge portion 39) of the toe cap 20 according to the present embodiment and the conventional type in the plan view.

Since bending of the toe is performed having the step portion B as the center, large bending does not occur on the mp line located at the front edge portion of the step portion B. Accordingly, there is no substantial difference in the manner of shoe bottom bending between the shoe to which the toe cap 20 according to the present invention is embedded as illustrated in FIG. 9(*c*) and the shoe to which the conventional toe cap 50 is embedded as illustrated in FIG. 9(*d*), so that they do not affect the toe bending motion substantially.

Further, the upper edge portion 39 is the edge portion comprising the rear end edge 27 of the toe cap 20 and the inner shoulder portion 37 and the outer shoulder portion 38 which are continued to the rear end edge 27 where the instep region closes when the foot is bent frontward. However, since the upper edge portion 39 is located above a position forward from the MP line where the toe does not bend, it is unlikely that the upper edge portion 39 contacts the instep region even when the foot is bent at the MP line.

FIG. 1 of Non-patent document 2 illustrates the posture falling on a knee at the time of a shoe bending test at "5.1 Specific ergonomic features". The bending posture described in the above embodiment is the posture defined by the ISO standards according to Non-patent document 2.

With the posture falling on a knee as defined in the standards, the shoe put on the rear foot is largely bent frontward. When such bending occurs, a swell region called a ball of a thumb contained in the step portion B is a main grounded area and the respective joints are bent. That is, bending is performed having the abovementioned MP line as the center, and bending is performed to a degree that the sole stands vertical as illustrated in FIG. 8(*b*).

Since a length and a shape of a foot are different in each person, strictly speaking, the positions of the MP line connecting the positions of the MP joints and the mp line obtained by shifting the MP line frontward differs in each person who wears a shoe. However, on this point, it is possible to set some typical positions in stages suitable to the shoe sizes based on dimensional values of toe caps standardized by JIS and the like. The conventional toe cap standardized by the standards, as illustrated in FIG. 8, allows bending of the toe while protecting the toe appropriately. That is, the horizontal distance a from the frontmost part to the central part of the arch rear end portion defined in the standards (i.e., 40 to 60 mm for H-class and S-class) is to have defined the position of the rear end edge of the toe cap where the protection of toe and toe bending go together. Then, the position can be determined with proportional conversion based on the typical shoe sizes such as 24 cm, 25 cm, . . . , and 30 cm corresponding to foot sizes.

The horizontal distance a which is set based on the above standards is as well a value which defines the position of the upper edge portion 39 of the toe cap 20 according to the embodiment of the present invention. From a view point of the function to balance the toe protection and the foot bending, it is preferable that the horizontal distance a matches with the dimensional value coinciding with the frontmost portion of the mp line.

As described above, in order to allow toe bending, it is required that the toe instep region does not strongly contact the upper edge portion 39 of the toe cap 20. The conventional toe cap has the rear end edge formed approximately to be perpendicular to the longitudinal direction of the shoe. The toe cap 20 according to the embodiment of the present invention as well has the upper edge portion 39 provided to be approximately perpendicular to the longitudinal direction of the shoe.

Meanwhile, the mp line is a curved line, both ends of which are directed to the rear side. Considering the relation with the instep alone, the upper edge portion 39 can be formed as an outer edge to a degree not to exceed the mp line.

Figure 12:
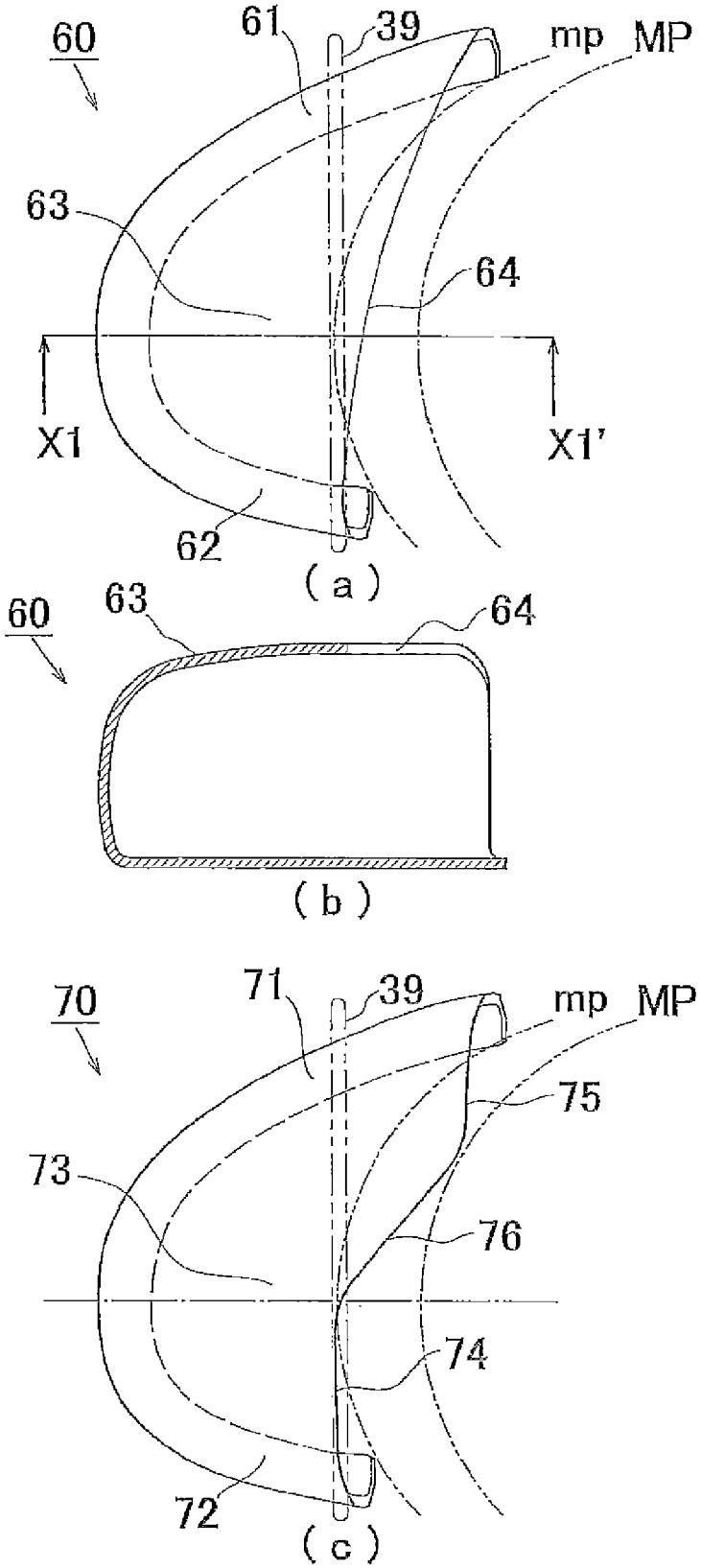
FIG. 12(*a*) is a plan view illustrating an example of a toe cap.

FIGS. 12(*a*) to 12(*c*) show examples of the shape of the toe caps having the extension side wall. FIG. 12(*a*) illustrates an example of the toe cap having the upper edge portion curved rearward. FIG. 12(*b*) is a sectional view laterally viewing the center position X1-X1' of FIG. 12(*a*).

The shape of the main body portion of the toe cap 60 illustrated in FIG. 12(*a*) is similar to that of the conventional toe cap. Here, a side wall 61 provided at the little toe side (i.e., the outer side) is formed long to extend rearward and a side wall 62 of the thumb side (i.e., the inner side) is disposed at the position similar to the conventional toe cap. Then, a rear end edge 64 of an upper face wall 63 is formed as smoothly connecting an upper part of the side wall 61 and an upper part of the side wall 62. Further, in this example, the rear end edge 64 connecting the right and left is shaped to largely exceed the abovementioned mp line.

With the toe cap 60 illustrated in this example, since the rear end edge 64 largely exceeds the mp line, the instep region contacts the rear end edge 64 when the toe is largely bent. Accordingly, further bending motion is to be disturbed.

The shape of the main body portion of a toe cap 70 illustrated in FIG. 12(*c*) is similar to that of the conventional toe cap. Here, a side wall 71 provided at the little toe side (i.e., the outer side) is formed long to extend rearward and a side wall 72 of the thumb side (i.e., the inner side) is disposed at the position similar to the conventional toe cap.

Then, the rear end edge 74 extending from the rear end center of an upper face wall 73 to the thumb side (i.e., the inner side) is formed in the position and shape similar to the conventional toe cap. A section extending from the center to the side wall 71 being the little toe side (i.e. the outer side) is formed in a shape having an end edge 75 extending from the side wall 71 being the little toe side (i.e., the outer side) to the center and an end edge 76 extending from the center of the upper face wall 73 to diagonally backward. According to the toe cap 70 illustrated in this example, since the rear end edge extending from the center to the outer side constituted by the end edge 75 and the end edge 76 largely exceeds the mp line, the instep region contacts the end edges 75, 76 when the toe is largely bent. Accordingly, further bending motion is disturbed.

Figure 13:
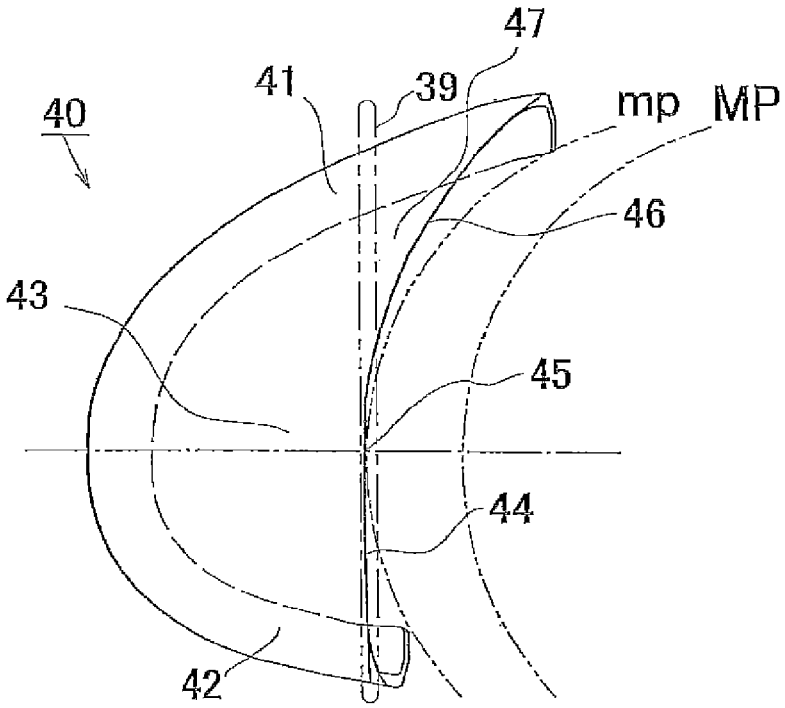
FIG. 13(*a*) is a plan view illustrating another example of the toe cap according to the present invention.
Figure 13:
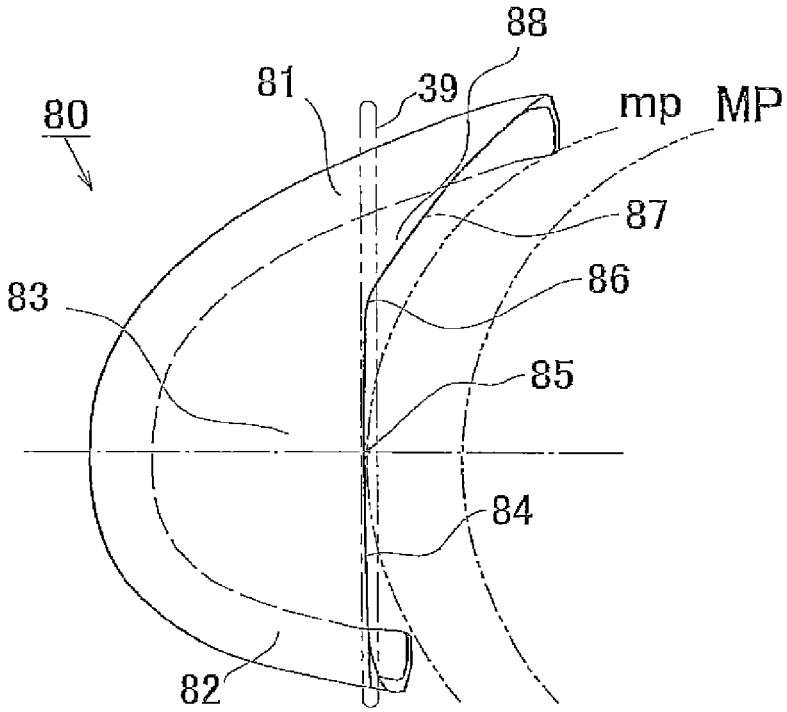

The shape of the main body portion of the toe cap 40 illustrated in FIG. 13(*a*) is similar to that of the conventional toe cap. Here, the side wall 41 at the little toe side (i.e., the outer side) is formed long to extend rearward and the side wall 42 of the thumb side (i.e., the inner side) is disposed at the position similar to the conventional toe cap.

Then, the rear end edge 44 extending from the rear end center 45 of the upper face wall 43 to the thumb side (i.e., the inner side) is formed in the position and shape similar to the conventional toe cap. The section extending from the rear end center 45 to the side wall 41 being the little toe side (i.e., the outer side) is formed as the curved edge 46 forming an arc extending from the rear end center 45 toward the inside of the rear end of the extension side wall disposed at the side wall 41 on the little toe side (i.e., the outer side). Furthermore, an extension upper wall 47 having the curved edge 46 as an end edge is formed at the outer rear portion of the upper face wall 43.

The curved edge 46 is formed at a position not to exceed the mp line. In a case of this shape, even when the foot is largely bent, the instep region is unlikely to contact the curved edge 46 and the bending motion is not disturbed. Here, even when the shape is similar to the curved edge 46, if the rear end edge is shaped to connect the center portion 45 and the rear end of the side wall 41 linearly in a plan view, the rear end edge exceeds the mp line, so that the bending motion of the foot is disturbed.

Further, in the toe cap 40, the extension upper wall 47 which connects the upper face wall 43 and the extension side wall continuously is arranged so as not to exceed the mp line at the position rearward to the portion corresponding to the upper edge portion 39 of the abovementioned toe cap 20. Since the extension upper wall 47 covers the upper side of the little toe while reinforcing the extension side wall, protection against load from the upper side is enhanced compared to the abovementioned toe cap.

The shape of the main body portion of a toe cap 80 illustrated in FIG. 13(*b*) is similar to that of the conventional toe cap. Here, a side wall 81 at the little toe side (i.e., the outer side) is formed long to extend rearward and a side wall 82 at the thumb side (i.e., the inner side) is disposed to the position similar to the conventional toe cap.

Further, a rear end edge 84 extending from a rear end center 85 of an upper face wall 83 to the thumb side (i.e., the inner side) is formed in the position and shape similar to the conventional toe cap. Further, an oblique end edge 87 is formed, which links a portion 86 located at a position closer to the little toe side (i.e., the outer side) than the rear end center 85 with the vicinity of the rear end edge of the extension side wall disposed at the side wall 81 at the little toe side.

The end edge 87 is provided at the position not to exceed the mp line. In the case of this shape, even if the toe is bent largely, the instep region is unlikely to contact the end edge 87 and the bending motion is not disturbed.

Further, the toe cap 80 is provided with an extension upper wall 88 linking the upper face wall 83 and the extension side wall continuously so as not to exceed the mp line at a more rearward position than the position corresponding to the upper edge portion 39 of the abovementioned toe cap 20. The extension upper wall 88 acts to reinforce the extension side wall. At the same time, since it covers the upper side of the little toe, protection against load from the upper side is enhanced compared to the abovementioned toe cap.

Lastly, description is made on the fold portion (i.e., the skirt) at the lower end. In a case that the toe cap 1 is provided with only the extension side wall 7 as illustrated in FIG. 1, there is a possibility that the extension side wall 7 is folded inward (i.e., to the opening side of the toe cap 1) when extremely large impact force is applied laterally (i.e., from the little toe side) to the extension side wall 7. In this case, it is possible to improve strength of the extension side wall 7 against the lateral direction by forming the fold portion (i.e., the skirt) 6 at the lower end of the extension side wall 7. With this structure, the extension side wall 7 is unlikely to be folded inward (i.e., to the opening side of the toe cap 1) and little toe protection against lateral impact force can be enhanced.

Further, in a case that only the extension side wall 7 is arranged without disposing the fold portion 6 to the toe cap 1, there is a possibility that the extension side wall 7 sinks toward the shoe bottom when a large impact caused by a fallen object and the like is applied to the extension side wall 7 from the upper side. When the sinking becomes deep, there arises a possibility that the load of a fallen object acts on the upper face of the little toe since the upper end edge of the extension side wall 7 becomes lower than the little toe. When the fold portion (i.e., the skirt) 6 is formed at the lower end of the extension side wall 7 similarly as described above, the extension side wall 7 becomes unlikely to sink toward the shoe bottom owing to increase of contacting area between the fold portion 6 and the shoe bottom. As a result, little toe protection is performed even when a large impact is applied from the upper side.

Industrial Applicability

The present invention can be utilized for a working shoe such as a safety shoe. Further, it is also possible to be utilized for a protective sneaker of an athletic shoe type, a general work shoe and a boot, etc. and to utilize as a toe retainer for a business shoe, etc.

DESCRIPTION OF REFERENCE NUMERALS

1 Toe cap
2 Front end wall
3 Left side (inner side) wall
4 Right side (outer side) wall
4*a* Outer face
4*b* Rear end
4*c* Inner face
5 Upper face wall
6 Fold portion
7 Extension side wall
8 Upper small wall (extension upper wall)
9 Rear end edge
10 Instep top
11 Toe underlining
12 Sockliner (insert)
13 Inner sole
14 Out-sole
15 Mid-sole
16 Side wall
17 Rear end edge
20 Toe cap
21 Front end wall
22 Left side wall
23 Right side wall
24 Upper face wall
25 Low-side fold portion
26 Extension side wall
27 Rear end edge
28 Curved portion
29 Rear end face
30 Corner portion
31 Boundary against main body portion (two-dotted chain line)
32 Instep top
33 Toe underlining
34 Sockliner (insert)
35 Mid-sole
36 Out-sole
37 Inner side shoulder portion
38 Outer side shoulder portion
39 Upper edge portion
40 Toe cap
41 Side wall at little toe side (outer side)
42 Side wall at thumb side (inner side)
43 Upper face wall
44 Rear end edge
45 Rear end center
46 Curved edge
47 Extension upper wall
50 Toe cap
52 Instep top
53 Toe underlining
54 Sockliner (insert)
55 Mid-sole
56 Out-sole
57 Rear end edge
60 Toe cap
61 Side wall at little toe side (outer side)
62 Side wall at thumb side (inner side)
63 Upper face wall
64 Rear end edge
70 Toe cap
71 Side wall at little toe side (outer side)
72 Side wall at thumb side (inner side)
73 Upper face wall
74 Rear end edge
75 End edge
76 End edge
80 Toe cap
81 Side wall at little toe side (outer side)
82 Side wall at thumb side (inner side)
83 Upper face wall
84 Rear end edge
85 Rear end center
86 Portion closer to little toe side (outer side)
87 End edge
88 Extension upper wall
90 Pedoscope
91 Glass plate
92 Light
93 Partition wall
94 Mirror
95 Camera
96 Curved line
97 Curved line
100 Toe cap
MP MP line
mp mp line
h1 Height
a Horizontal distance
A Toe
B Step portion
C Plantar arch
D Heel
F Foot
G Phalanx
J Metatarsal
K Shoe
L Little toe
S Wheel
T Thumb
Y Rear end edge

The invention claimed is:

1. A toe cap to be embedded in a shoe to protect a toe from impacts of a wheel of a dolly carrying heavy loads, the toe cap comprising:

a body formed into a cup-shaped shell having a continuously curved surface formed by a front end wall, a left side wall, a right side wall and an upper face wall;

the left side wall or the right side wall at a little toe side of the toe cap is provided with an extension side wall extending farther rearward than a central portion of a rear end edge of the upper face wall for covering a side of the little toe of a foot inside the shoe;

the rear end edge of the upper face wall is arranged along a direction approximately perpendicular to a longitudinal direction of the toe cap;

the rear end edge of the upper face wall is formed to extend short of an imaginary line connecting the metatarsal phalanx joint of each toe of a foot inside the shoe so as not to disturb bending motion of the foot; and the extension side wall extends from either the left side wall or the right side wall of the body farther rearward than any other part of the toe cap, the extension side wall has a rear end face that extends substantially perpendicular to a bottom face of the toe cap, and the extension side wall has a height and a length to cover the little toe of the foot inside the shoe, so that the toe cap prevents the wheel of the dolly carrying heavy loads and colliding with the extension side wall from running on the little toe and does not disturb bending motion of a foot inside the shoe.

2. The toe cap according to claim 1, wherein the extension side wall has a substantially rectangle shape.

3. The toe cap according to claim 1, wherein the toe cap has an extension upper wall continuously connecting the upper face wall and the extension side wall.

4. The toe cap according to claim 2, wherein the toe cap has an extension upper wall continuously connecting the upper face wall and the extension side wall.

5. A shoe having the toe cap according to claim 1.

6. A shoe having the toe cap according to claim 2.

7. A shoe having the toe cap according to claim 4.

* * * * *